US012187470B2

(12) United States Patent
Sikora et al.

(10) Patent No.: US 12,187,470 B2
(45) **Date of Patent: *Jan. 7, 2025**

(54) STRAPPING TOOL

(71) Applicant: Golden Bear LLC, Columbus, OH (US)

(72) Inventors: Joshua Robert Sikora, Columbus, OH (US); Charles Russell Patzer, Columbus, OH (US)

(73) Assignee: Golden Bear LLC, Columbus, OH (US)

( * ) Notice: Subject to any disclaimer, the term of this patent is extended or adjusted under 35 U.S.C. 154(b) by 637 days.

This patent is subject to a terminal disclaimer.

(21) Appl. No.: 17/486,227

(22) Filed: Sep. 27, 2021

(65) Prior Publication Data

US 2022/0009659 A1 Jan. 13, 2022

Related U.S. Application Data

(62) Division of application No. 16/282,235, filed on Feb. 21, 2019, now Pat. No. 11,130,598.
(Continued)

(51) Int. Cl.
*B65B 13/34* (2006.01)
*B65B 13/02* (2006.01)
(Continued)

(52) U.S. Cl.
CPC ..... *B65B 13/345* (2013.01); *B65B 13/025* (2013.01); *B65B 13/184* (2013.01); *B65B 13/187* (2013.01); *B65B 13/22* (2013.01)

(58) Field of Classification Search
CPC ... B65B 13/345; B65B 13/025; B65B 13/184; B65B 13/187; B65B 13/22; B65B 13/305; B65B 13/24; B65B 13/327; B65B 13/188
See application file for complete search history.

(56) References Cited

U.S. PATENT DOCUMENTS 2,386,153 A 10/1945 Watt et al.
3,089,366 A 5/1963 Haraden
(Continued)

OTHER PUBLICATIONS

PCT Form 210, International Search Report for PCT/US2019/019044, mailed on May 7, 2019.
(Continued)

*Primary Examiner* — Teresa M Ekiert
(74) *Attorney, Agent, or Firm* — The Law Office of Patrick F. O'Reilly III, LLC

(57) ABSTRACT

A strapping tool is disclosed herein. In one or more embodiments, the strapping tool includes a motive power source; and a tensioning assembly operatively coupled to the motive power source, the tensioning assembly including a cam member and at least one tensioning foot member, the cam member operatively coupling the at least one tensioning foot member to the motive power source, and the at least one tensioning foot member of the tensioning assembly configured to apply tension to a piece of strapping while being driven in an oscillatory manner by the motive power source. Also, in one or more embodiments, the strapping tool includes a jaw lifting assembly, the jaw lifting assembly configured to raise the at least one sealing jaw member out of a strapping pass line of the strapping tool so that the piece of strapping is capable of being inserted into the strapping tool.

15 Claims, 18 Drawing Sheets

Related U.S. Application Data

(60) Provisional application No. 62/633,138, filed on Feb. 21, 2018.

(51) Int. Cl.
*B65B 13/18* (2006.01)
*B65B 13/22* (2006.01)

(56) References Cited

U.S. PATENT DOCUMENTS 3,144,888 A 8/1964 Palmer
3,329,178 A 7/1967 Plunkett
3,333,608 A 8/1967 Xaver
3,530,809 A 9/1970 Porter
3,552,450 A 1/1971 Plunkett
3,654,033 A 4/1972 Angarola et al.
3,799,835 A 3/1974 Gilmore
3,810,495 A 5/1974 Pack
3,851,576 A * 12/1974 Takahashi ..... B65B 13/22 53/589
4,027,609 A 6/1977 Kerr
4,096,019 A 6/1978 Lehmann
4,166,422 A 9/1979 Porter
4,412,498 A 11/1983 Scholl
4,449,464 A 5/1984 Porter
4,545,234 A 10/1985 Schnellmann
4,871,414 A 10/1989 Niedrig
5,476,569 A 12/1995 Harada
5,526,761 A 6/1996 Mulcahey et al.
5,632,851 A 5/1997 Young
5,653,095 A 8/1997 Stamm
5,942,061 A 8/1999 Figiel et al.
5,954,899 A 9/1999 Figiel et al.
6,308,760 B1 10/2001 Finzo et al.
6,328,087 B1 12/2001 Finzo et al.
6,332,306 B1 12/2001 Finzo et al.
6,895,733 B2 5/2005 Nix
6,957,678 B2 10/2005 Scholl et al.
6,966,255 B1 11/2005 Crittenden
7,073,431 B1 7/2006 Chen
7,428,866 B2 9/2008 Reiche
8,578,997 B2 11/2013 Rauch
9,789,984 B2 10/2017 Sikora et al.
10,745,158 B2 8/2020 Sikora et al.
10,793,303 B2 10/2020 Sikora et al.
11,130,598 B2 9/2021 Sikora et al.
2009/0013656 A1 1/2009 Nasiatka et al.
2011/0056392 A1 3/2011 Neeser et al.
2011/0083596 A1 4/2011 Asao et al.
2012/0060735 A1 3/2012 Dickerson
2012/0085274 A1 4/2012 Bardh et al.
2013/0085053 A1 4/2013 Figiel et al.
2014/0007781 A1* 1/2014 Sikora ..... B65B 13/027 100/29
2014/0083311 A1 3/2014 Bonifazi et al.
2014/0290179 A1 10/2014 Keller
2015/0210411 A1 7/2015 Finzo et al.
2015/0321777 A1 11/2015 Nasiatka et al.
2016/0016682 A1 1/2016 Boss et al.
2016/0107775 A1* 4/2016 Amacker ..... B65B 13/327 100/29
2016/0167814 A1 6/2016 Figiel et al.
2017/0008652 A1 1/2017 Figiel et al.
2017/0166335 A1 6/2017 Nasiatka et al.
2017/0174374 A1 6/2017 Figiel et al.
2018/0037347 A1 2/2018 Sikora et al.
2018/0127124 A1 5/2018 Sikora et al.

OTHER PUBLICATIONS

PCT Form 237, Written Opinion of the International Searching Authority for PCT/US2019/019044, mailed on May 7, 2019.

* cited by examiner

Detail A-1

Detail A-2

Detail A-3

Detail "C"

Detail "D"

STRAPPING TOOL

CROSS-REFERENCE TO RELATED APPLICATIONS

This is a divisional of U.S. Nonprovisional patent application Ser. No. 16/282,235, entitled "Strapping Tool", filed on Feb. 21, 2019, which claims priority to U.S. Provisional Patent Application No. 62/633,138, entitled "Strapping Tool", filed on Feb. 21, 2018, the disclosure of each of which is hereby incorporated by reference as if set forth in their entireties herein.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a strapping tool. More particularly, the invention relates to a strapping tool that is configured to apply tension to a piece of strapping, and/or to notch or crimp a strapping seal member that secures end portions of the piece of strapping to one another.

2. Background

Various tools are known in the packaging art for performing numerous functions related to the manipulation of strapping, which is commonly used as a closing mechanism for packages, and as a convenient means for easily attaching two objects to one another (e.g., attaching a box to a pallet). Some of these conventional tools are powered directly from a centralized system, such as a building electrical system or a central pneumatic system. Other conventional packaging tools have a power supply that is an integral part of the tool. Both of the aforementioned types of conventional packaging tools have numerous limitations and drawbacks. For example, conventional combination strapping tools, which perform both tensioning and sealing operations, utilize a vast array of intricate components, resulting in these tools being overly complicated, and quite expensive. Also, because these conventional tools comprise many intricate components subject to failure, they are often not as reliable as desired by the users thereof.

Therefore, what is needed is a strapping tool that utilizes fewer and simpler components than conventional tools so as to reduce the overall complexity of the tool, and thereby provide a more cost effective alternative for performing strapping operations. Moreover, there is a need for a strapping tool that is more reliable than conventional strapping tools so as to minimize the disruption of strapping operations resulting from tool repairs and replacements. Furthermore, there is a need for a strapping tool that is easier to transport than conventional strapping tools.

BRIEF SUMMARY OF EMBODIMENTS OF THE INVENTION

Accordingly, the present invention is directed to a strapping tool that substantially obviates one or more problems resulting from the limitations and deficiencies of the related art.

In accordance with one or more embodiments of the present invention, there is provided a strapping tool. The strapping tool includes a motive power source; and a tensioning assembly operatively coupled to the motive power source, the tensioning assembly including a cam member and at least one tensioning foot member, the cam member operatively coupling the at least one tensioning foot member to the motive power source, and the at least one tensioning foot member of the tensioning assembly configured to apply tension to a piece of strapping while being driven in an oscillatory manner by the motive power source.

In a further embodiment of the present invention, the motive power source comprises one of: (i) a pneumatic motor, (ii) an electric motor, and (iii) a liquid fuel-based motor.

In yet a further embodiment, the cam member is in the form of an eccentric cam member.

In still a further embodiment, the strapping tool further comprises a cam bracket member, the at least one tensioning foot member being operatively coupled to the cam member by means of the cam bracket member.

In accordance with one or more other embodiments of the present invention, there is provided a strapping tool. The strapping tool includes a sealing assembly, the sealing assembly comprising at least one sealing jaw member, the at least one sealing jaw member of the sealing assembly configured to notch or crimp a strapping seal member so as to secure a piece of strapping around a package or bundle of items; and a jaw lifting assembly, the jaw lifting assembly configured to raise the at least one sealing jaw member out of a strapping pass line of the strapping tool so that the piece of strapping is capable of being inserted into the strapping tool.

In a further embodiment of the present invention, the jaw lifting assembly raises a portion of the sealing assembly that includes the at least one sealing jaw member, but does not raise the entire sealing assembly.

In yet a further embodiment, the at least one sealing jaw member comprises a body portion with an elongate aperture formed therethrough, the elongate aperture of the at least one sealing jaw member enabling the at least one sealing jaw member to be retractably displaced into the strapping tool when the at least one sealing jaw member is raised by the jaw lifting assembly.

In still a further embodiment, the at least one sealing jaw member of the sealing assembly comprises a pair of sealing jaw members, the pair of sealing jaw members configured to be raised simultaneously by the jaw lifting assembly out of the strapping pass line of the strapping tool.

In yet a further embodiment, the jaw lifting assembly comprises a handle member operatively coupled to the at least one sealing jaw member; and, when the handle member is depressed by a user, the at least one sealing jaw member is configured to be raised out of the strapping pass line of the strapping tool.

In still a further embodiment, the strapping tool further comprises a tensioning assembly, the tensioning assembly configured to apply tension to the piece of strapping; and the sealing assembly of the strapping tool is not pivotably coupled to the tensioning assembly of the strapping tool.

In yet a further embodiment, the strapping tool further comprises a jaw locking mechanism configured to prevent the at least one sealing jaw member from being inadvertently lifted out of the strapping pass line.

In still a further embodiment, the at least one sealing jaw member of the sealing assembly comprises a plurality of sealing jaw members on one side of the strapping tool, the plurality of sealing jaw members configured to be raised simultaneously by the jaw lifting assembly out of the strapping pass line of the strapping tool.

In accordance with yet one or more other embodiments of the present invention, there is provided a strapping tool. The strapping tool includes a motive power source; and a sealing assembly operatively coupled to the motive power source, the sealing assembly comprising at least one cam member, at least one follower member disposed around the at least one cam member, and at least one sealing jaw member, the at least one cam member and the at least one follower member operatively coupling the at least one sealing jaw member to the motive power source, and the at least one sealing jaw member of the sealing assembly configured to notch or crimp a strapping seal member so as to secure a piece of strapping around a package or bundle of items.

In a further embodiment of the present invention, the at least one cam member of the sealing assembly comprises a first cam member and a second cam member and the at least one sealing jaw member of the sealing assembly comprises a first pair of sealing jaw members and a second pair of sealing jaw members, each of the first and second cam members being operatively coupled to the motive power source, the first cam member being operatively coupled to the first pair of sealing jaw members so as to selectively activate the first pair of sealing jaw members, and the second cam member being operatively coupled to the second pair of sealing jaw members so as to selectively activate the second pair of sealing jaw members.

In yet a further embodiment, the at least one follower member of the sealing assembly comprises a first follower member and a second follower member, and wherein the first pair of sealing jaw members are operatively coupled to the first cam member by the first follower member, and the second pair of sealing jaw members are operatively coupled to the second cam member by the second follower member.

In still a further embodiment, the strapping tool further comprises a tensioning assembly, the tensioning assembly configured to apply tension to the piece of strapping; and the motive power source supplies power to both the sealing assembly and the tensioning assembly by means of a drive shaft.

In yet a further embodiment, the strapping tool further comprises one or more one-way bearings disposed on the drive shaft so as to enable the tensioning assembly to be actuated by rotating the drive shaft in a first rotational direction and the sealing assembly to be actuated by rotating the drive shaft in a second rotational direction that is opposite to the first rotational direction.

In still a further embodiment, the strapping tool further comprises a clutch subassembly operatively coupled to the drive shaft so as to enable the tensioning assembly to be actuated by rotating the drive shaft in a first rotational direction and the sealing assembly to be actuated by rotating the drive shaft in a second rotational direction that is opposite to the first rotational direction.

In yet a further embodiment, the strapping tool further comprises a one-way ratchet subassembly or one-way indexing subassembly coupled to the drive shaft so as to enable the tensioning assembly to be actuated by rotating the drive shaft in a first rotational direction and the sealing assembly to be actuated by rotating the drive shaft in a second rotational direction that is opposite to the first rotational direction.

In still a further embodiment, the sealing assembly further comprises a cutting blade for cutting the piece of strapping, the cutting blade being driven by the drive shaft that provides power to the sealing assembly and the tensioning assembly.

In yet a further embodiment, the strapping tool further comprises a single control button configured to control the operation of both the tensioning assembly and the sealing assembly.

In still a further embodiment, the strapping tool further comprises a plurality of control buttons, a first one of the plurality of control buttons configured to control the operation of the tensioning assembly, and a second one of the plurality of control buttons configured to control the operation of the sealing assembly.

In yet a further embodiment, the strapping tool further comprises a guide member for constraining a displacement of the at least one follower member to a direction normal to a surface of the piece of strapping.

In still a further embodiment, the strapping tool further comprises a jaw lifting assembly, the jaw lifting assembly configured to raise the at least one sealing jaw member out of a strapping pass line of the strapping tool so that the piece of strapping is capable of being inserted into the strapping tool; and the at least one sealing jaw member comprises a body portion with an elongate aperture formed therethrough, the elongate aperture of the at least one sealing jaw member enabling the at least one sealing jaw member to be retractably displaced into the strapping tool when the at least one sealing jaw member is raised by the jaw lifting assembly.

In yet a further embodiment, the strapping tool further comprises a cam bearing member operatively coupling the at least one sealing jaw member to the at least one follower member, a portion of the cam bearing member being disposed within the elongate aperture of the at least one sealing jaw member; and, when the at least one sealing jaw member is actuated by the motive power source into a sealing position for sealing the strapping seal member, the cam bearing member is displaced within the elongate aperture of the at least one sealing jaw member while the at least one sealing jaw member is pivoted about a rotational axis.

In still a further embodiment, the strapping tool further comprises a jaw lifting assembly, the jaw lifting assembly configured to raise the at least one sealing jaw member out of a strapping pass line of the strapping tool so that the piece of strapping is capable of being inserted into the strapping tool; and a jaw locking mechanism configured to prevent the at least one sealing jaw member from being inadvertently lifted out of the strapping pass line.

In yet a further embodiment, the strapping tool further comprises a downwardly extending protrusion configured to prevent the at least one sealing jaw member from being inadvertently raised when an underside of the strapping tool contacts an object.

In accordance with still one or more other embodiments of the present invention, there is provided a strapping tool. The strapping tool includes a sealing assembly, the sealing assembly comprising at least one sealing jaw member, the at least one sealing jaw member of the sealing assembly configured to notch or crimp a strapping seal member so as to secure a piece of strapping around a package or bundle of items; and a jaw releasing assembly, the jaw releasing assembly configured to displace the at least one sealing jaw member out of a strapping pass line of the strapping tool and/or engage and displace the piece of strapping from the strapping tool.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Figure 1:
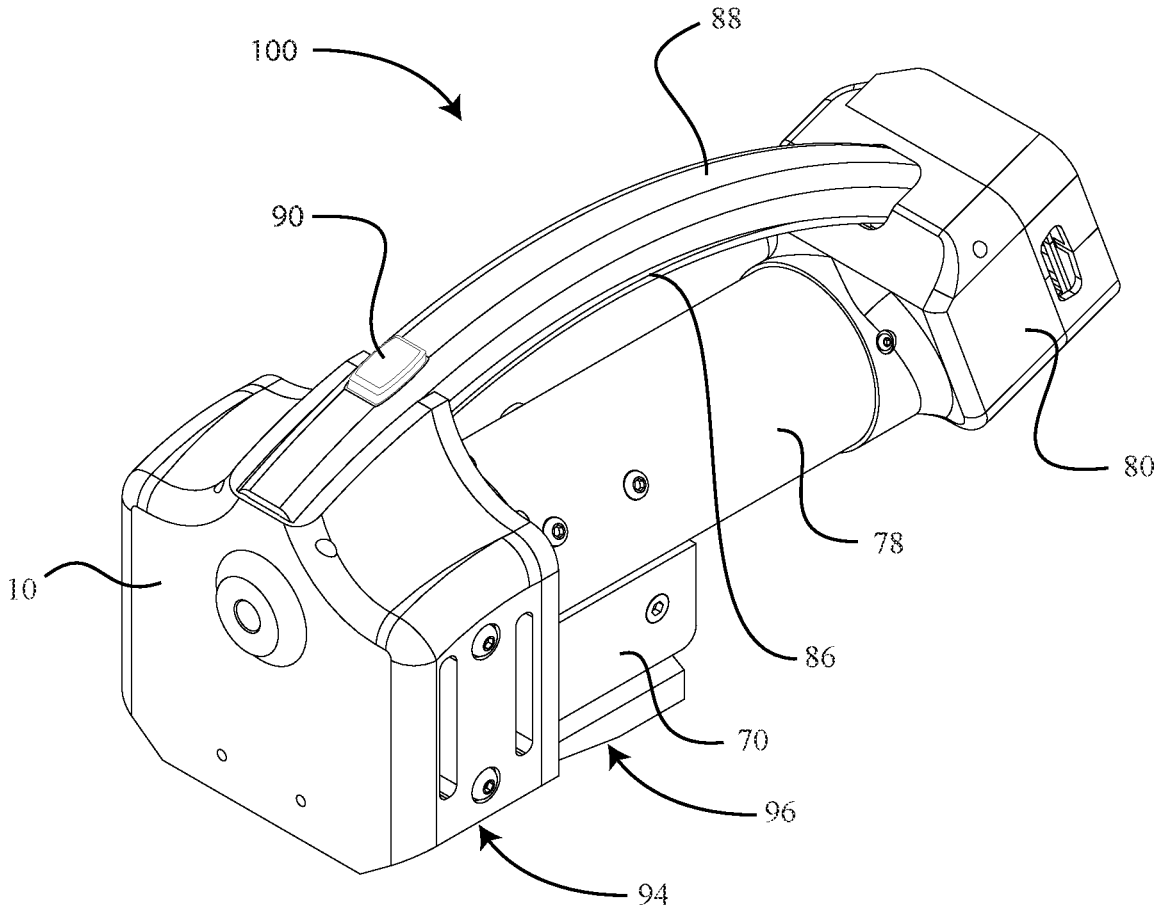
FIG. 1 is an assembled perspective view of a strapping tool, according to a first embodiment of the invention.

It should be understood all references to direction and position in the drawings, unless otherwise indicated, refer to the orientation of the strapping tools as presented in the drawings. For example, in FIG. 6*a* and other front end views depicted in the drawings, the left side of the tool refers to the left side of the front end view, and the right side of the tool refers to right side of the front end view.

Throughout the figures, the same parts are always denoted using the same reference characters so that, as a general rule, they will only be described once.

DETAILED DESCRIPTION OF EMBODIMENTS OF THE INVENTION

Figure 3:
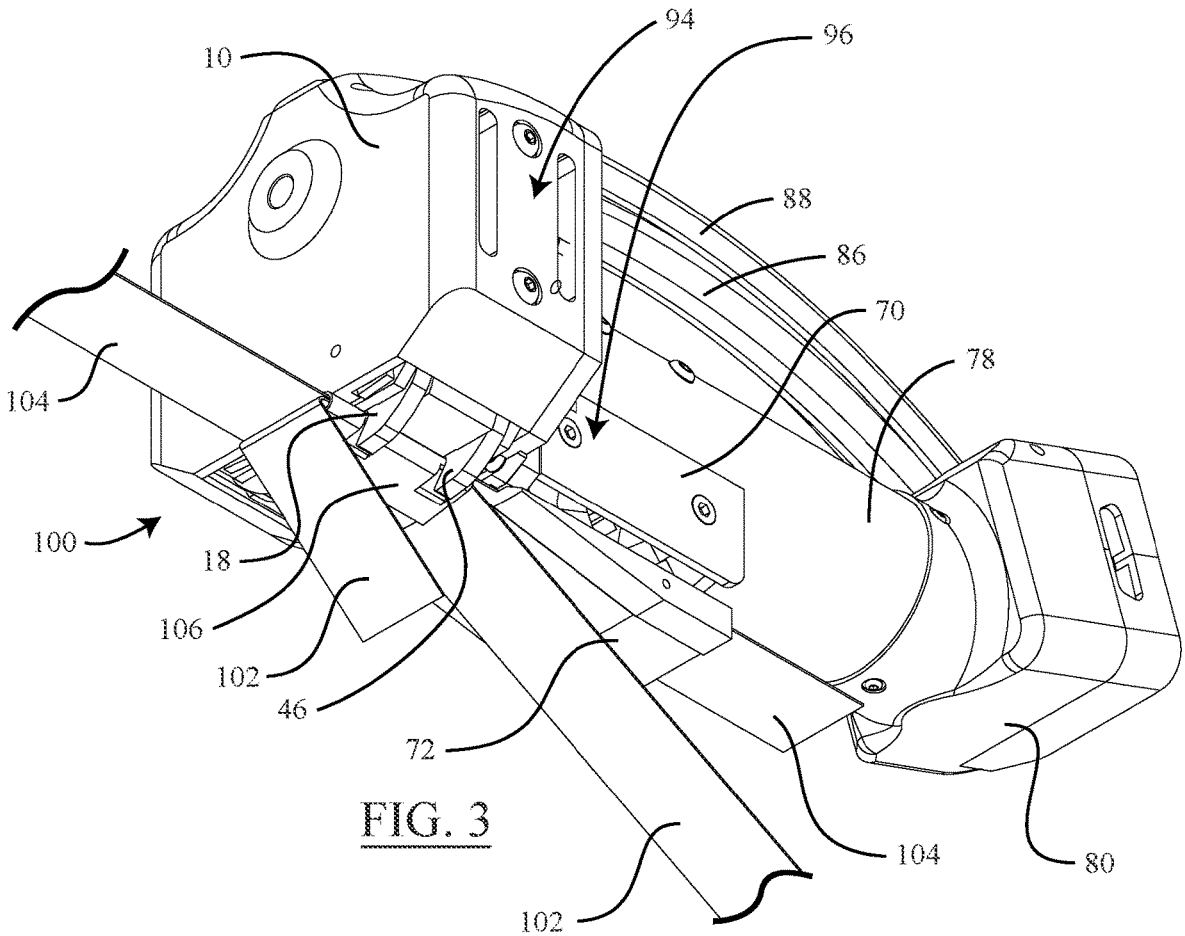
FIG. 3 is a bottom perspective view of the strapping tool of FIG. 1, wherein the strapping tool is shown notching a seal member of a piece of strapping.
Figure 4:
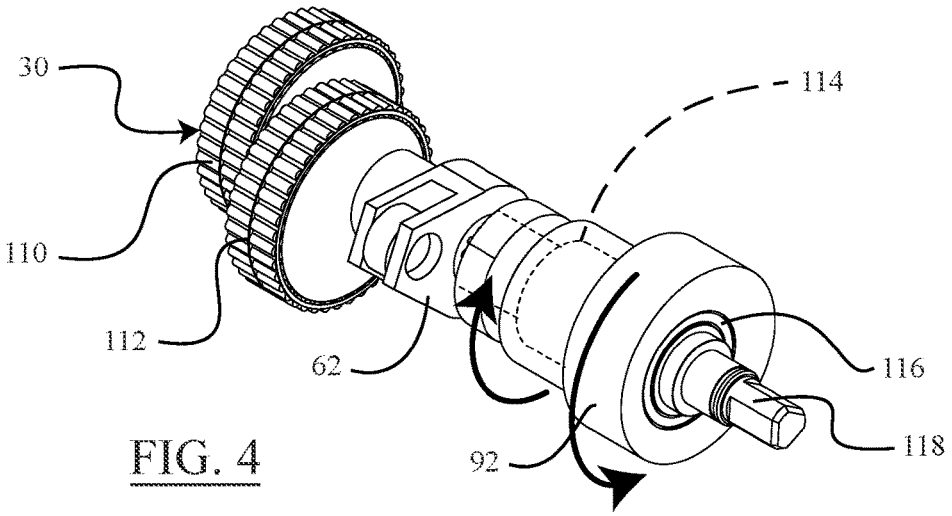
FIG. 4 is a perspective view of a cam assembly of the strapping tool of FIG. 1.
Figure 5:
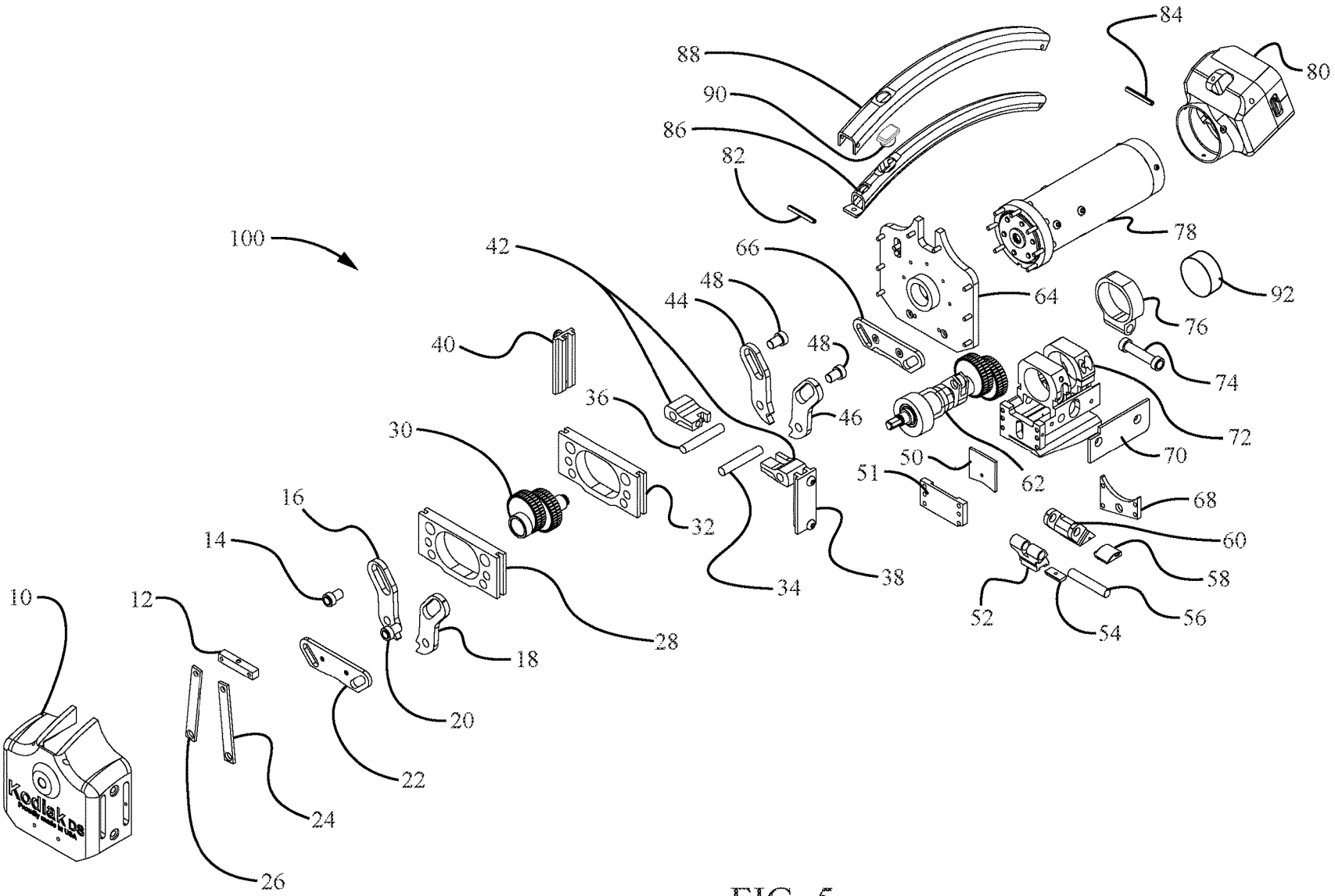
FIG. 5 is an exploded perspective view of the strapping tool of FIG. 1.
Figure 19:
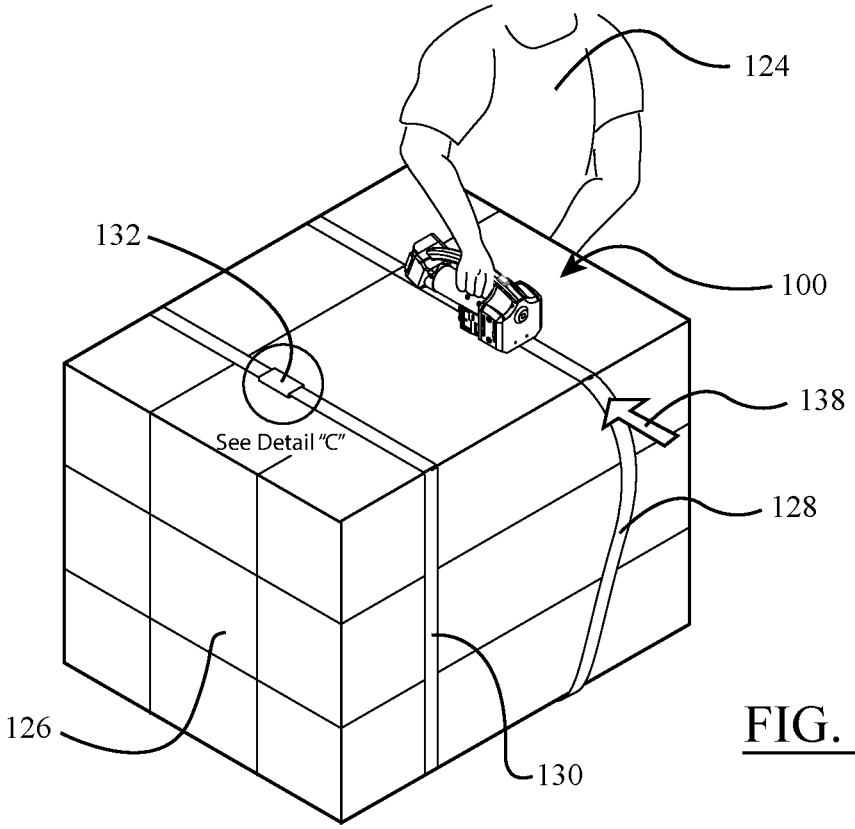
FIG. 19 is a perspective view of a user utilizing the strapping tool of FIG. 1 to secure strapping around a bundle of timber members.
Figure 20:
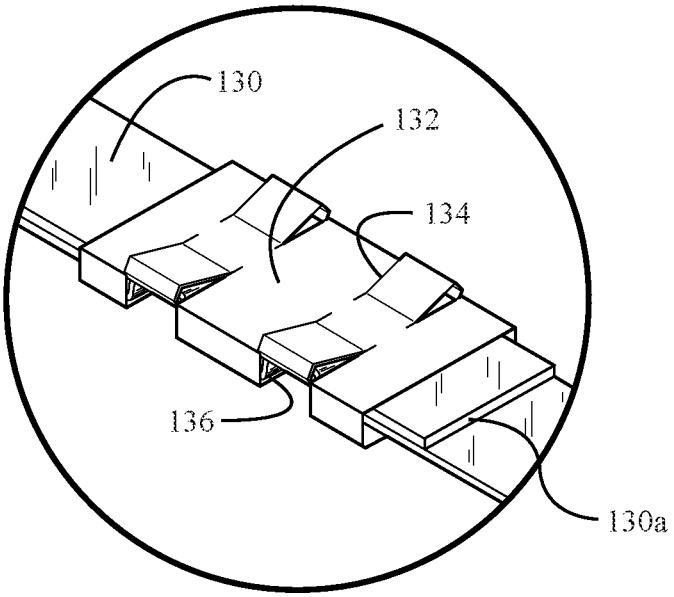
FIG. 20 is a perspective view of a strapping seal member illustrating the notched portions of the strapping seal member formed by the sealing assembly of the strapping tool described herein (Detail "C")

A first illustrative embodiment of the strapping tool is seen generally at 100 in FIGS. 1-20. An exploded perspective view of the assemblies that form the strapping tool 100 is depicted in FIG. 5. Initially with reference to the illustrative embodiment of FIGS. 1 and 2, it can be seen that the strapping tool 100 generally comprises a motive power source 78; a tensioning assembly 96 operatively coupled to the motive power source 78, and configured to apply tension to a piece of strapping; and a sealing assembly 94 operatively coupled to the motive power source 78, and configured to notch a strapping seal member 106 so as to secure a piece of strapping with strapping portions 102, 104 (see FIGS. 2 and 3) around a package or bundle of items. For example, as shown in FIG. 19, first and second straps 128, 130 may be secured around a package of wood timber members 126. Initially, as shown in FIG. 19, a user 124 utilizes the tensioning assembly 96 of the strapping tool 100 for tensioning the strap 128 (e.g., in the direction indicated by arrow 138). Then, after the strap is pulled tight using the tensioning assembly 96, the sealing assembly 94 of the strapping tool 100 is used to notch the strapping seal members 132 so as to secure the end portions of the straps 128, 130 to one another. As shown in the detail view of FIG. 20, the free end 130*a* of the strap 130 is secured using the seal member 132 by forming notched portions 134 in the strap 130 and seal member 132 by utilizing the sealing assembly 94 of the strapping tool 100. In FIG. 20, it can be seen that the notched portions 134 are bent upwardly so as to be separated from the unnotched edges 136 of the seal member 132.

While the sealing assembly 94 of the strapping tool 100 notches the strapping seal member 106 in the illustrative embodiment, it is to be understood that, in other embodiments, the sealing assembly of the strapping tool may crimp the seal member rather than notch the seal member. That is, in these other embodiments, the strapping tool may be used with a crimp-type seal member, rather than the illustrated notch-type seal member 106.

In the illustrative embodiment, with reference to FIGS. 5, 10-12*b*, 17, and 18, it can be seen that the tensioning assembly 96 generally includes a tension cam member 92 and a tensioning leg 60 with a tensioning foot member 58 disposed at the bottom end thereof. The tension cam member 92 operatively couples the tensioning foot member 58 to the motive power source 78. As will be described in detail hereinafter, the tensioning foot member 58 of the tensioning assembly 96 is configured to apply tension to a piece of strapping 104 (see FIG. 11*a*) while being driven in an oscillatory manner by the motive power source (e.g., motor 78). As shown in the exploded view of FIG. 5 and the rear views of FIGS. 11*b* and 12*b*, in the illustrative embodiment, the tensioning assembly 96 of the strapping tool 100 further comprises a holding bar 52, a holding bar foot 54, a holding bar pin 56, a tension frame housing 72, a tension leg pin 74, and a tension cam bracket 76. When the piece of strapping 104 is being tensioned (as shown in FIGS. 11*a* and 12*a*), the holding bar or leg 52 with associated foot 54 holds the strap 104 in place so that the strap is unable to slide in a direction opposite to the tensioning direction. In the illustrative embodiment, the holding leg 52 is pivotally mounted to the tension frame housing 72 by means of the holding bar pin 56. During the tensioning of the strap 104, the holding leg 52 is not driven by the motor 78, but rather is manually pivotable about the holding bar pin 56. In the illustrative embodiment, the holding foot 54, which is disposed at the bottom of the holding leg 52, may be formed from a suitable rubber material so that the foot 54 is able to frictionally engage, and hold the strap 104 in place as it is being tensioned (see FIGS. 10, 11*a*, and 12*a*). The tensioning foot member 58, which is driven by the motor 78 during the tensioning of the strap 104, is pivotable about the leg pin 74 during the tensioning of the strap 104. The leg pin 74 connects the tensioning leg 60 to the tension cam bracket 76, and is received within an oval-shaped aperture in the tension frame housing 72 (see FIGS. 5 and 11*a*).

Figure 11A:
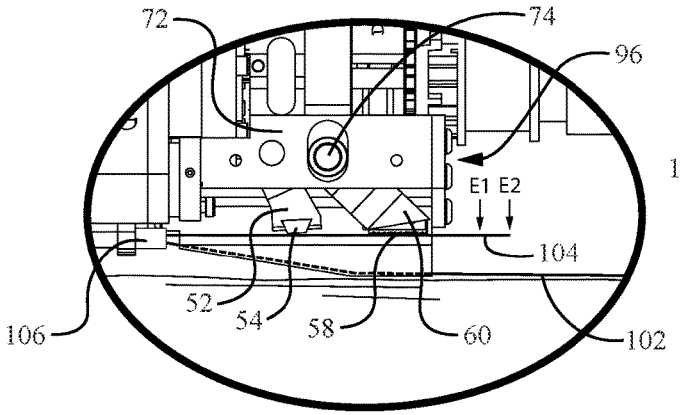
FIG. 11*a* is another enlarged partial side view of the tensioning assembly shown together with the piece of strapping as the strapping is being advanced by the tensioning foot to a second position during an initial strap displacement cycle (Detail "A-2")
Figure 11B:
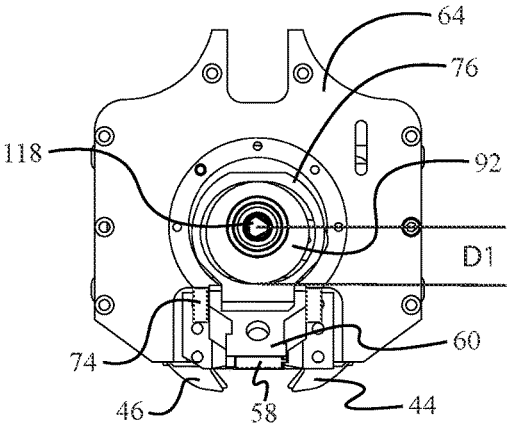
FIG. 11*b* is a rear elevational view of the internal components of the tensioning assembly of the strapping tool of FIG. 1, wherein the distance between the center of the cam shaft and the surface of the tension cam is shown as the strapping is being advanced by the tensioning foot during the initial strap displacement cycle.
Figure 12A:
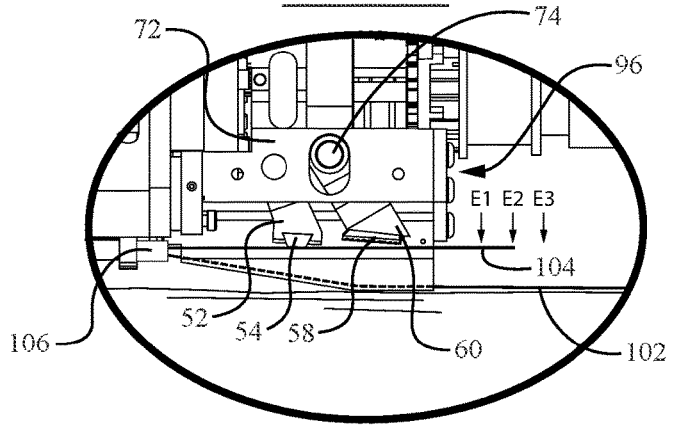
FIG. 12*a* is another enlarged partial side view of the tensioning assembly shown together with the piece of strapping at the second position as the tensioning foot is resetting for a subsequent strap displacement cycle (Detail "A-3")
Figure 12B:
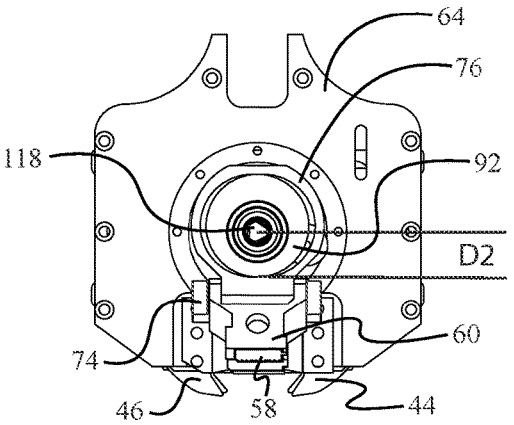
FIG. 12*b* is a rear elevational view of the internal components of the tensioning assembly of the strapping tool of FIG. 1, wherein the distance between the center of the cam shaft and the surface of the tension cam is shown as the tensioning foot is resetting for the subsequent strap displacement cycle.

Now, with reference primarily to FIGS. 10-12*b*, the functionality of the tensioning assembly 96 of the strapping tool 100 will be described. Initially, when the cam shaft 118 is driven in a tensioning direction by the motor 78, the tension cam member 92 is rotated by the cam shaft 118. As the tension cam member 92 rotates through its cycle, the tension cam bracket 76, which acts as a cam follower (the cam 92 fits inside cam bracket 76), is either driven up or down (see FIGS. 11*b* and 12*b*) by the tension cam member 92, which is in the form of an eccentric cam member in the illustrative embodiment. In turn, the up and down displacement of the tension cam bracket 76 causes the tensioning leg member 60, which is operatively coupled to the tension cam bracket 76 by the pin 74, to oscillate backwards and forwards so as to apply tension to the strap 104. In other embodiments, the displacement of the tension cam bracket 76 may include lateral displacements as well as the generally vertical displacements of the illustrative embodiment (e.g., the tension cam bracket 76 may be diagonally displaced). In particular, referring to FIG. 10, it can be seen that the end of the strap 104 being tensioned initially is disposed at the location E1 before tension has been applied thereto. Then, turning to FIG. 11*a*, as tension is being applied to the strap 104 during a first cycle by the tensioning foot 58 on the end of the tensioning leg member 60, the end of the strap 104 has been displaced to the location E2 (i.e., the strap 104 has been displaced to the right in FIG. 11*a*). As shown in FIG. 11*b*, when the tensioning foot 58 is disposed in its tensioning position of FIG. 11*a*, the distance D1 defines the distance between the center of the cam shaft 118 and the location where the cam surface of tension cam member 92 contacts the bottom surface of the central recess of the tension cam bracket 76 (i.e., the tension cam bracket 76 is driven downwardly by the thick section of the cam 92 in FIG. 11*b* so that the tensioning foot 58 is pushed downwardly against the strap 104 for tensioning). FIG. 11*b* depicts the state of the cam 92 and tension cam bracket 76 when foot 58 is fully extended. Finally, referring to FIG. 12*a*, after tension has been applied to the strap 104 during the first cycle by the tensioning foot 58, the tensioning foot 58 is shown resetting for the second cycle, as the holding foot 54 is shown pivoting so as to engage the tensioned strap 104 and maintain the tension force thereon throughout the tensioning operation until the strap 104 is cut by the cutting blade 50, as described hereinafter. As shown in FIG. 12*b*, when the tensioning foot 58 is disposed in its resetting position of FIG. 12*a* during the resetting phase thereof, the distance D2 defines the distance between the center of the cam shaft 118 and the location where the cam surface of tension cam member 92 contacts the bottom surface of the central recess of the tension cam bracket 76 (i.e., the tension cam bracket 76 travels upwardly when the thin section of the cam 92 in FIG. 12*b* contacts the bottom surface of the central recess of the tension cam bracket 76 so that the tensioning foot 58 is reset for the tensioning cycle). In the illustrative embodiment, during the resetting of the tensioning foot 58, the foot 58 may be held down against the strap 104 by a spring (i.e., a downward spring force is applied to the foot 58 to maintain the foot 58 in contact with the strap 104 during the resetting thereof). In FIG. 12*a*, the position of the foot 58 is exaggerated slightly to better distinguish the resetting stroke from the tensioning stroke. FIG. 12*b* depicts the state of the cam 92 and tension cam bracket 76 when the foot 58 is retracted back to start the cycle over. In FIG. 12*a*, location E3 designates the future location of the end of the strap 104 after the second cycle of tensioning has concluded (i.e., the strap 104 will be displaced to the right in FIG. 12*a* to the location E3 after the second tensioning cycle). In the illustrative embodiment, during the tensioning operation of the strapping tool 100, the tensioning foot 58 advances the tensioned strap 104 a predetermined amount (e.g., one-eighth of an inch) during each cycle. During the tensioning operation, the tensioning foot 58 continually grabs and pulls a predetermined amount of strapping 104 through the seal member and the holding foot 54 prevents the strapping 104 from slipping back. During each tensioning cycle, the foot 58 resets and grabs another predetermined amount of strap 104 (e.g., one-eighth of an inch) as it is forced down and out the back of the tool 100. After sufficient tension is applied to the strap, the tensioning operation is concluded, the motor 78 reverses, and the sealing operations described hereinafter are performed.

While only the tensioning foot 58 is driven in the illustrative embodiment, it is to be understood that, in other embodiments, both feet 54, 58 may be driven by the motor 78 of the strapping tool 100.

In the illustrative embodiment, referring again to the exploded view of FIG. 5, it can be seen that the tensioning assembly 96 may further include a plurality of cover plates 68, 70 that attach to the tension frame housing 72 so as to cover portions of the tensioning assembly 96 components. In the illustrative embodiment, the plurality of cover plates 68, 70 may be formed from a polymeric material or suitable plastic. In one or more embodiments, the cover plate 70 may be transparent (i.e., in the form of a clear window) so that internal components of the tensioning assembly 96 are visible to the user during the operation of the strapping tool 100 (e.g., so the feet 54, 58 are visible to the user to facilitate the loading of the tool 100).

Referring again to FIGS. 3-5, in the illustrative embodiment, the motor 78 supplies power to both the sealing assembly 94 and the tensioning assembly 96 by means of the single cam drive shaft 118. In the illustrative embodiment, with reference to the cam and bearing subassembly 30 depicted in FIG. 4, the strapping tool 100 further comprises a plurality of one-way bearings 114, 116 disposed on the cam drive shaft 118 so as to enable the tensioning assembly 96 to be actuated by rotating the cam drive shaft 118 in a first rotational direction (e.g., a counterclockwise direction), and the sealing assembly 94 and the cutting operations to be actuated by rotating the drive shaft 118 in a second rotational direction (e.g., a clockwise direction) that is opposite to the first rotational direction. As a result of the one-way bearings 114, 116, the sealing cams 110, 112 do not rotate when the cam drive shaft 118 rotates in the first rotational direction, and the tension cam member 92 does not rotate when the cam drive shaft 118 rotates in the second rotational direction. As shown in FIG. 4, in addition to the one-way bearings 114, 116, the cam and bearing subassembly 30 further includes a front sealing cam 110, a rear sealing cam 112, a cut cam 62, and the tension cam member 92 disposed on the one-way bearing 116.

While one-way bearings 114, 116 are utilized in the illustrative embodiment for regulating the tensioning, sealing, and cutting operations of the strapping tool 100, other means for controlling the directional rotation of the cam drive shaft 118 may be used. For example, in one or more alternative embodiments, a clutch subassembly may be operatively coupled to the cam drive shaft 118 rather than the one-way bearings 114, 116 so as to enable the tensioning assembly 94 to be actuated by rotating the drive shaft 118 in a first rotational direction and the sealing assembly 96 and the cutting operations to be actuated by rotating the drive shaft 118 in a second rotational direction that is opposite to the first rotational direction. As another example, in one or more other alternative embodiments, a one-way ratchet subassembly or one-way indexing subassembly may be operatively coupled to the cam drive shaft 118 rather than the one-way bearings 114, 116 so as to enable the tensioning assembly 94 to be actuated by rotating the drive shaft 118 in a first rotational direction and the sealing assembly 96 and the cutting operations to be actuated by rotating the drive shaft 118 in a second rotational direction that is opposite to the first rotational direction.

In the illustrative embodiment, the motive power source 78 is in the form of electric motor powered by the battery pack 80. However, in other embodiments, other types of motive power sources may be used, such as pneumatic motors, liquid fuel-based motors (e.g., gasoline-powered motors), motors driven by mechanical spring assemblies, and manually-actuated power sources (e.g., a power source driven by the turning of a crank by user, etc.).

Also, while a single electric motor 78 drives both the tensioning assembly 96 and the sealing assembly 94 in the illustrative embodiment, separate motors may be used for the tensioning and sealing assemblies 96, 94 in alternative embodiments.

Next, with reference primarily to FIGS. 4, 5, and 13*a*-16, the sealing assembly 94 of the illustrative strapping tool 100 will be described in detail. In the illustrative embodiment, referring initially to FIGS. 4, 5, 13*a*, and 13*b*, it can be seen that the sealing assembly 94 generally includes a plurality of cam members 110, 112, a plurality of cam follower members 28, 32, and a plurality of sealing jaw members 16, 18, 44, 46. As shown in FIG. 4, the plurality of cam members 110, 112 of the sealing assembly 94 comprises a first cam member 110 (i.e., a front sealing cam 110) and a second cam member 112 (i.e., a rear sealing cam 112) disposed on the cam shaft 118 driven by motor 78. In the illustrative embodiment, each of the cam members 110, 112 is eccentric, and thus has a variable radii cam surface geometry. Also, in the illustrative embodiment, the plurality of sealing jaw members 16, 18, 44, 46 of the sealing assembly 94 comprises a front pair of sealing jaw members 16, 18 and a rear pair of sealing jaw members 44, 46. As shown in FIGS. 5 and 13*a*-15, it can be seen that the sealing jaw members 16, 18, 44, 46 each comprise respective sealing teeth for forming the notched portions 108 in the seal member 106 (see FIG. 2). In addition, referring to FIGS. 4, 13*b*, and 14*b*, each of the first and second cam members 110, 112 is operatively coupled to the electric motor 78 by means of the cam shaft 118 (i.e., the cams 110, 112 are both simultaneously rotated by the cam shaft 118). The first cam member 110 is operatively coupled to the front pair of sealing jaw members 16, 18 by the front cam follower member 28 so as to selectively activate the front pair of sealing jaw members 16, 18 (see FIGS. 13*a*, 14*a*, and 15). The second cam member 112 is operatively coupled to the rear pair of sealing jaw members 44, 46 by the rear cam follower member 32 so as to selectively activate the rear pair of sealing jaw members 44, 46 (see FIGS. 13*b*, 14*b*, 17, and 18). Turning again to FIGS. 13*a*-15, 17, and 18, it can be seen that the front pair of sealing jaw members 16, 18 are operatively coupled to the front cam follower member 28 by a first pair of cam bearings 14, 20, while the rear pair of sealing jaw members 44, 46 are operatively coupled to the rear cam follower member 32 by a second pair of cam bearings 48. In the illustrative embodiment, the front and rear cam follower members 28, 32 are in form of front and rear sealing cam plate members with respective central apertures formed therein for receiving the respective first and second cam members 110, 112. In the illustrative embodiment, the front and rear cam subassemblies of the sealing assembly 94 may be in the form of positive drive cams where the cam follower members 28, 32 are disposed around, and circumscribe their respective cam members 110, 112.

Figure 17:
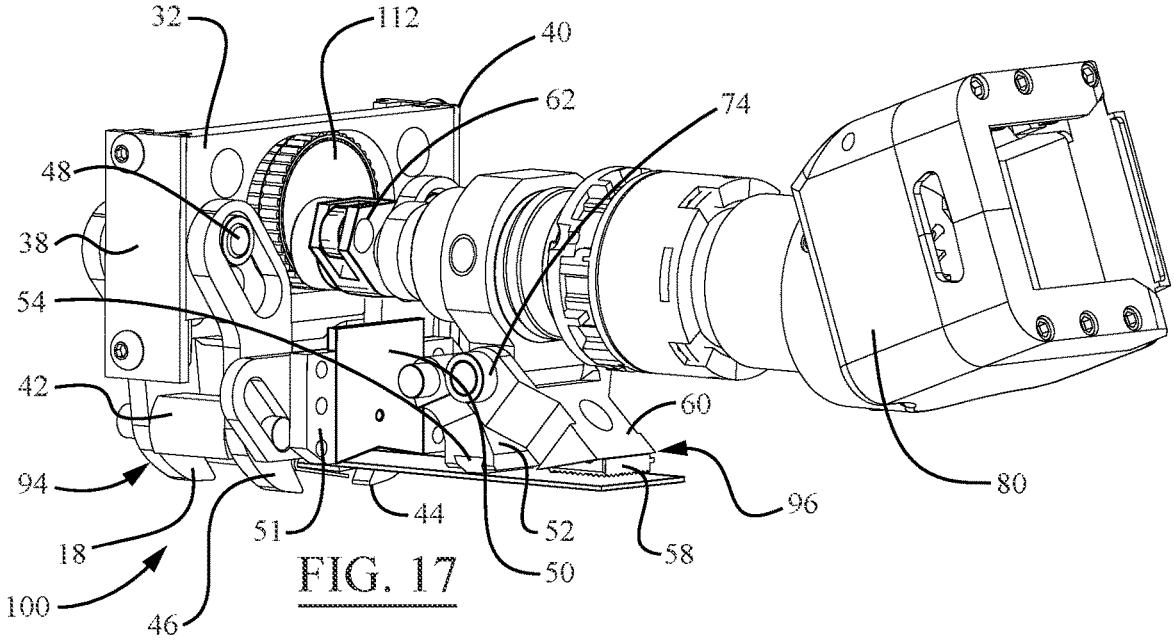
FIG. 17 is yet another side perspective view of the strapping tool of FIG. 1, wherein the entire housing of the strapping tool has been removed to more clearly illustrate the cutting blade of the strapping tool in a disengaged, non-cutting position.
Figure 18:
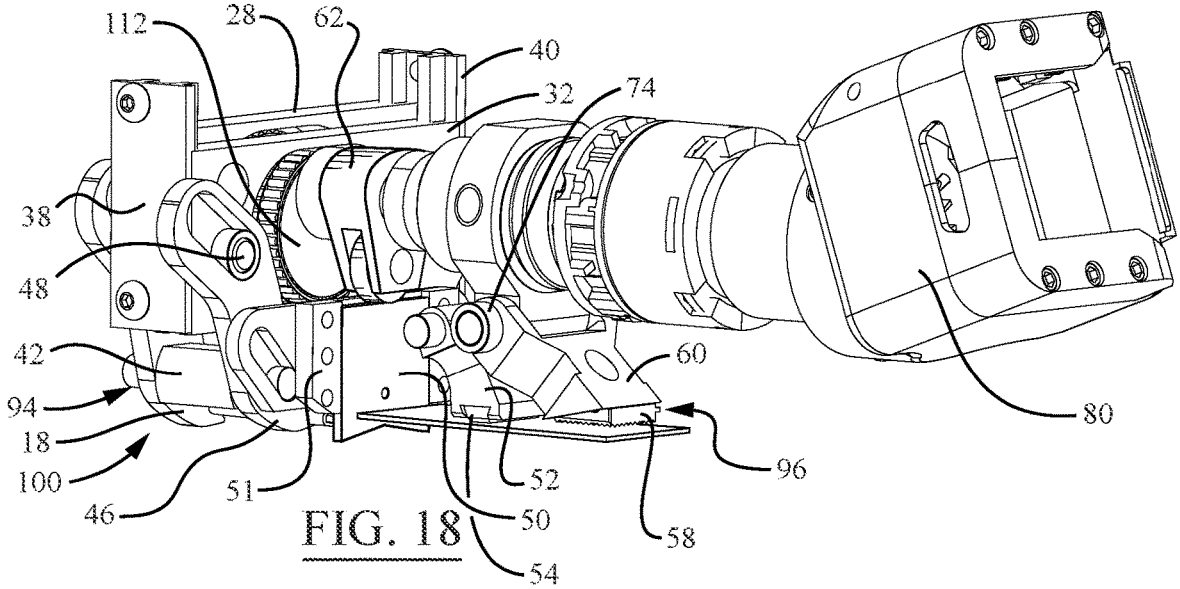
FIG. 18 is still another side perspective view of the strapping tool of FIG. 1, wherein the entire housing of the strapping tool has been removed to more clearly illustrate the cutting blade of the strapping tool in an engaged, cutting position.

In the illustrative embodiment, as shown in FIGS. 5, 17, and 18, the sealing assembly 94 further comprises first and second sealing guide members 38, 40 for constraining the displacement of the front and rear cam follower members 28, 32 to a direction normal to a surface of the piece of strapping 104 (i.e., an upward/downward displacement). As best shown in FIGS. 5, 17, and 18, the front and rear cam follower members 28, 32 comprise grooves on the outer sides thereof that slidingly engage with protruding rails formed on the first and second sealing guide members 38, 40 such that the front and rear cam follower members 28, 32 slide up and down relative to the first and second sealing guide members 38, 40 when follower members 28, 32 are displaced by the cam members 110, 112.

Referring again to FIGS. 13*a*-15, 17, and 18, it can be seen that the lower end portions of the front sealing jaw members 16, 18 are connected together by means of a front connector member 22, while the lower end portions of the rear sealing jaw members 44, 46 are connected together by means of a rear connector member 66. The front and rear connector members 22, 66 act as jaw spacer members. Elongate jaw pivot pins 34, 36 extend in the front-to-back direction of the strapping tool 100, and pass through spaced-apart apertures in the front and rear connector members 22, 66 so as to couple the front pair of sealing jaw members 16, 18 to the rear pair of sealing jaw members 44, 46 (see FIGS. 5, 13*b*, 14*b*, 17, and 18). The sealing jaw members 16, 44 disposed on the first side of the strapping tool 100 both pivot about the jaw pivot pin 36 during the notching of the seal member 106, while the sealing jaw members 18, 46 disposed on the second side of the strapping tool 100 both pivot about the jaw pivot pin 34 during the notching of the seal member 106. Also, referring to FIGS. 5, 13*b*, 14*b*, 17, and 18, it can be seen that the sealing assembly 94 further comprises a pair of center jaw spacer members 42 for providing front-to-back spacing between the sealing jaw members 16, 44 on the first side of the strapping tool 100, and front-to-back spacing between the sealing jaw members 18, 46 on the second side of the strapping tool 100.

Figure 2:
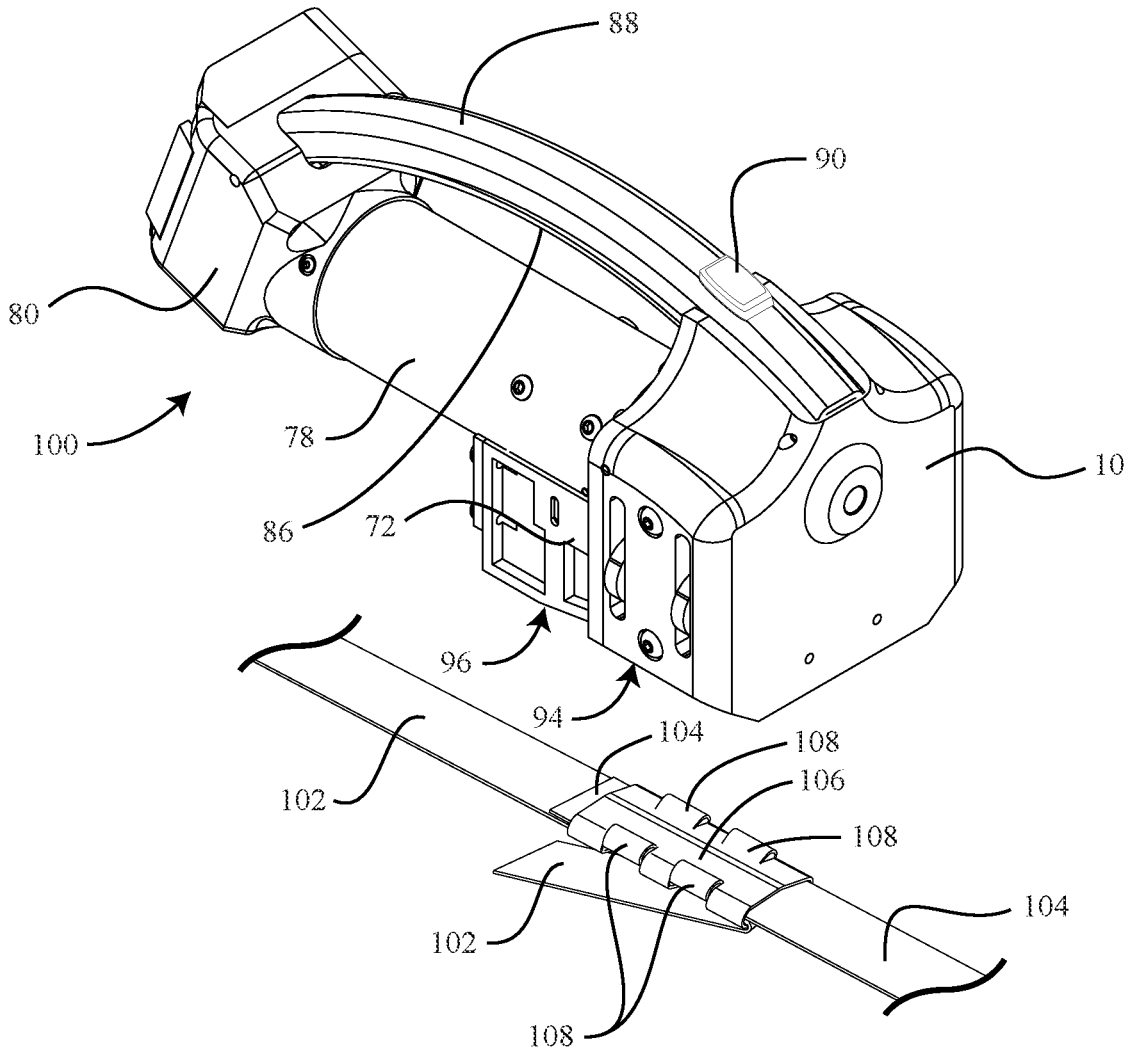
FIG. 2 is another perspective view of the strapping tool of FIG. 1, wherein the opposite side of the strapping tool is illustrated together with a piece of strapping and seal member.

As best shown in FIGS. 1, 2, 5, and 6*a*, in the illustrative embodiment, the internal components of the sealing assembly 94 are housed within the front housing member 10 of the strapping tool 100 and rear housing member 64. Collectively, the front and rear housing members 10, 64 enclose the constituent components of the sealing assembly 94. Also, as shown in FIGS. 1, 2, and 5, it can be seen that the strapping tool 100 is provided with a rechargeable battery pack 80 that is removable from its battery mount on the rear end portion of the strapping tool 100 so that the battery 80 can be easily charged. In the illustrative embodiment, the rechargeable battery pack 80 is capable of powering both the electric motor 78 that drives both the tensioning assembly 96 and the sealing assembly 94.

Figure 13A:
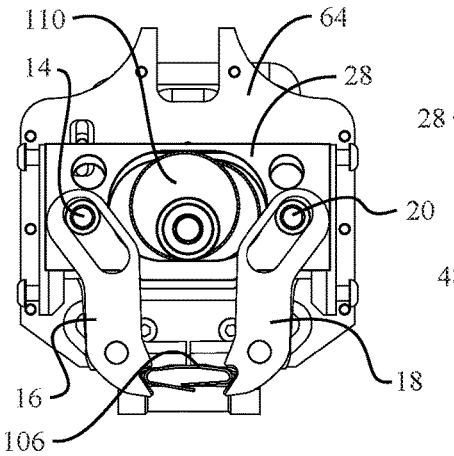
FIG. 13*a* is yet another front end view of the internal components of the sealing assembly of the strapping tool of FIG. 1, wherein the jaws of the sealing assembly are shown in the engaging, lowered state after a piece of strapping and seal member has been loaded into the strapping tool.
Figure 13B:
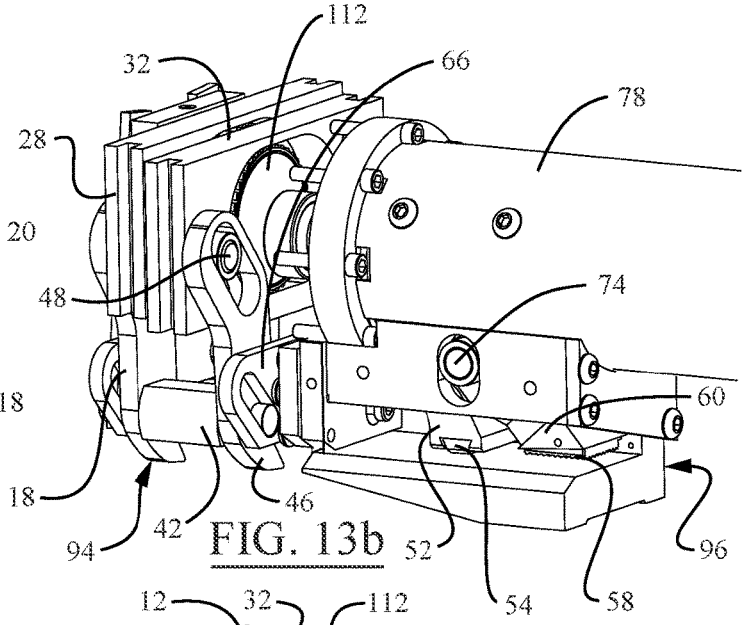
FIG. 13*b* is a side perspective view of the strapping tool of FIG. 1, wherein the cover of the sealing assembly has been removed so as to illustrate the displaceable sealing cam plate members.
Figure 14A:
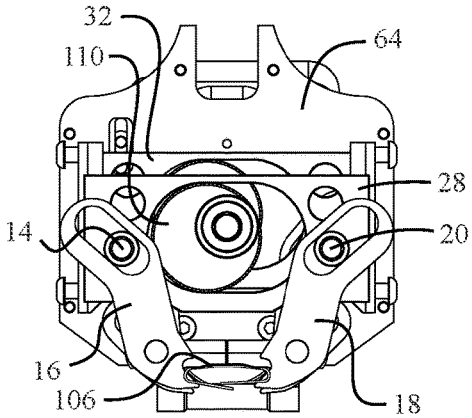
FIG. 14*a* is still another front end view of the internal components of the sealing assembly of the strapping tool of FIG. 1, wherein the front pair of the sealing jaws have been driven into engaged sealing positions by the displacement of the front sealing cam plate member, while the rear pair of the sealing jaw members are in disengaged positions.
Figure 14B:
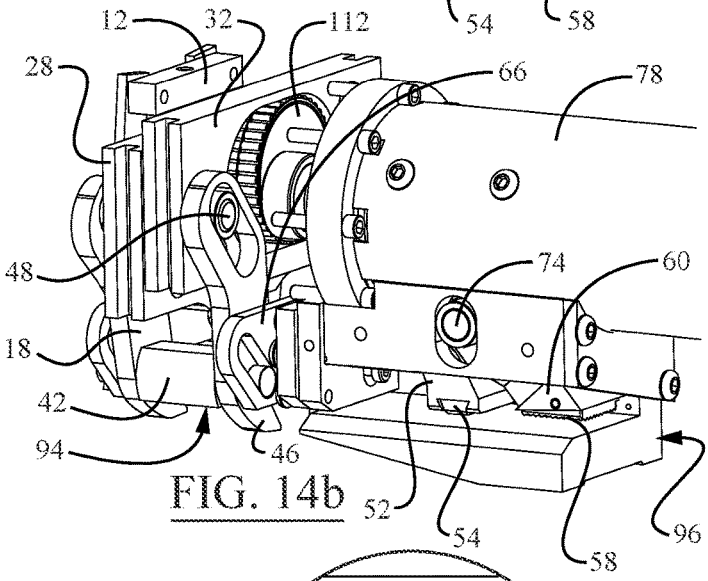
FIG. 14*b* is another side perspective view of the strapping tool of FIG. 1, wherein the cover and guides of the sealing assembly have been removed so as to illustrate the displacement of the front sealing cam plate member.
Figure 15:
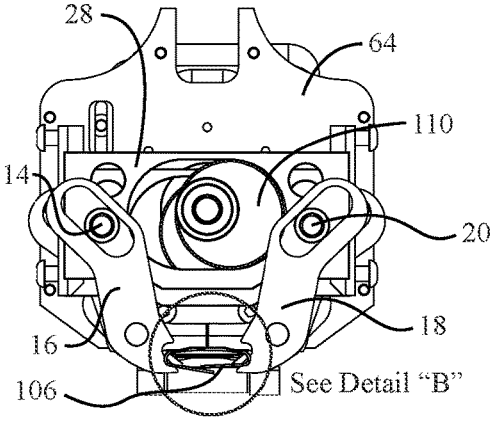
FIG. 15 is yet another front end view of the internal components of the sealing assembly of the strapping tool of FIG. 1, wherein the rear pair of the sealing jaws have been driven into engaged sealing positions by the displacement of the rear sealing cam plate member, while the front pair of the sealing jaw members are in disengaged positions.
Figure 16:
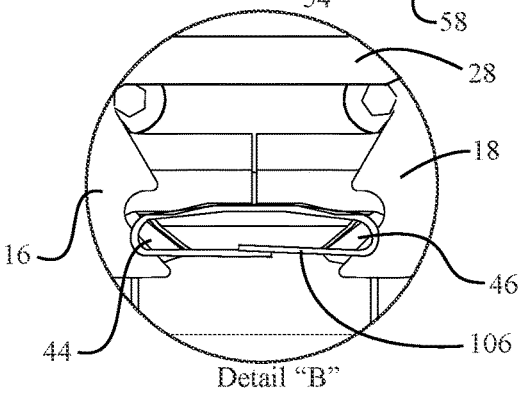
FIG. 16 is an enlarged front view of the front and rear pairs of sealing jaws, and a strapping seal member (Detail "B"), wherein the front sealing jaws are disposed in disengaged positions and the rear sealing jaws are disposed in engaged sealing positions.

Now, with reference primarily to FIGS. 13*a*-15, the functionality of the sealing assembly 94 of the strapping tool 100 will be described. Initially, when the cam shaft 118 is driven in a sealing direction by the motor 78, the first and second cam members 110, 112 are rotated by the cam shaft 118. As the first and second cam members 110, 112 rotate through their cycles, the front and rear cam follower members 28, 32 are either raised or lowered by the cam members 110, 112, which are in the form of eccentric cam members in the illustrative embodiment. In turn, the up and down displacement of the cam follower members 28, 32 causes sealing jaw members 16, 44 to rotate about jaw pivot pin 36 and the sealing jaw members 18, 46 to rotate about jaw pivot pin 34. The sealing jaw members 16, 44 rotate about the jaw pivot pin 36 in an oscillatory manner between engaged and disengaged positions, while the sealing jaw members 18, 46 rotate about the jaw pivot pin 34 in an oscillatory manner between engaged and disengaged positions. Different operational positions of the sealing assembly 94 are illustrated in FIGS. 13*a*-15. In FIGS. 13*a* and 13*b*, both the front and rear pairs of sealing jaw members 16, 18, 44, 46 are in their disengaged positions. FIGS. 13*a* and 13*b* depict the positions of the sealing jaw members 16, 18, 44, 46 after the jaw lifting assembly (as will be described hereinafter) lifts the jaw members 16, 18, 44, 46, and strap and seal member 106 have been inserted into the strapping tool 100. In FIGS. 14*a* and 14*b*, the front sealing jaw members 16, 18 are in their engaged sealing positions, while the rear sealing jaw members 44, 46 are in their disengaged positions. In the operational state depicted in FIGS. 14*a* and 14*b*, the front sealing jaw members 16, 18 notch the seal member 106 while the seal member 106 is held in place by the rear sealing jaw members 44, 46. During the notching of the seal member 106, the first and second cam members 110, 112 rotate out of sync with one another (i.e., cam surface portions are not aligned) such that one of the cam follower members 28, 32 is in a raised position and the other of the cam follower members 28, 32 is in a lowered position. In the operational state depicted in FIGS. 14*a* and 14*b*, the front cam follower member 28 is in a lowered position, while the rear cam follower member 32 is in a raised position. Finally, in FIGS. 15 and 16, the front sealing jaw members 16, 18 are in their disengaged positions and the rear sealing jaw members 44, 46 are in their engaged sealing positions. In the operational state depicted in FIGS. 15 and 16, the front sealing jaw members 16, 18 hold the seal member 106 while the seal member 106 is notched by the rear sealing jaw members 44, 46. Also, in the operational state depicted in FIGS. 15 and 16, the front cam follower member 28 is in a raised position, while the rear cam follower member 32 is in a lowered position.

In the illustrative embodiment, the strapping tool 100 further comprises a control system operatively coupled to the electric motor 78 for controlling the operation of the tensioning and sealing assemblies 96, 94. As shown in FIGS. 1 and 2, the control system of the illustrative strapping tool 100 includes a single control button 90 configured to control the operation of both the tensioning assembly 96 and the sealing assembly 94 (i.e., when depressed by a user, the control button 90 initiates the tensioning and sealing operations of the strapping tool 100). Although, while a single control button 90 is used in the illustrative embodiment, in other alternative embodiments, the control system of the strapping tool 100 includes a plurality of control buttons for controlling the tensioning and sealing operations of the tool 100. In these alternative embodiments, at least a first one of the control buttons may be configured to control the operation of the tensioning assembly 96, while at least a second one of the control buttons may be configured to control the operation of the sealing assembly 94. In the illustrative embodiment, the control system of the strapping tool 100 further comprises a microcontroller for performing the central processing operations for the control of the strapping tool 100.

Figure 6A:
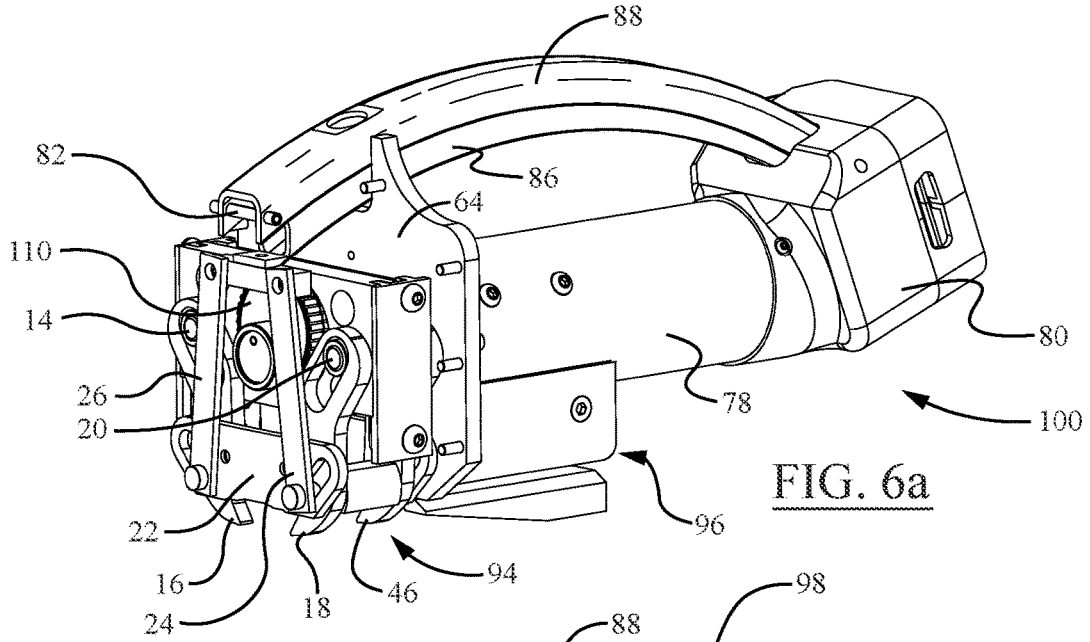
FIG. 6*a* is yet another perspective view of the strapping tool of FIG. 1, wherein the front cover of the sealing assembly has been removed, and the jaws of the sealing assembly are shown in an engaging, lowered state.
Figure 7A:
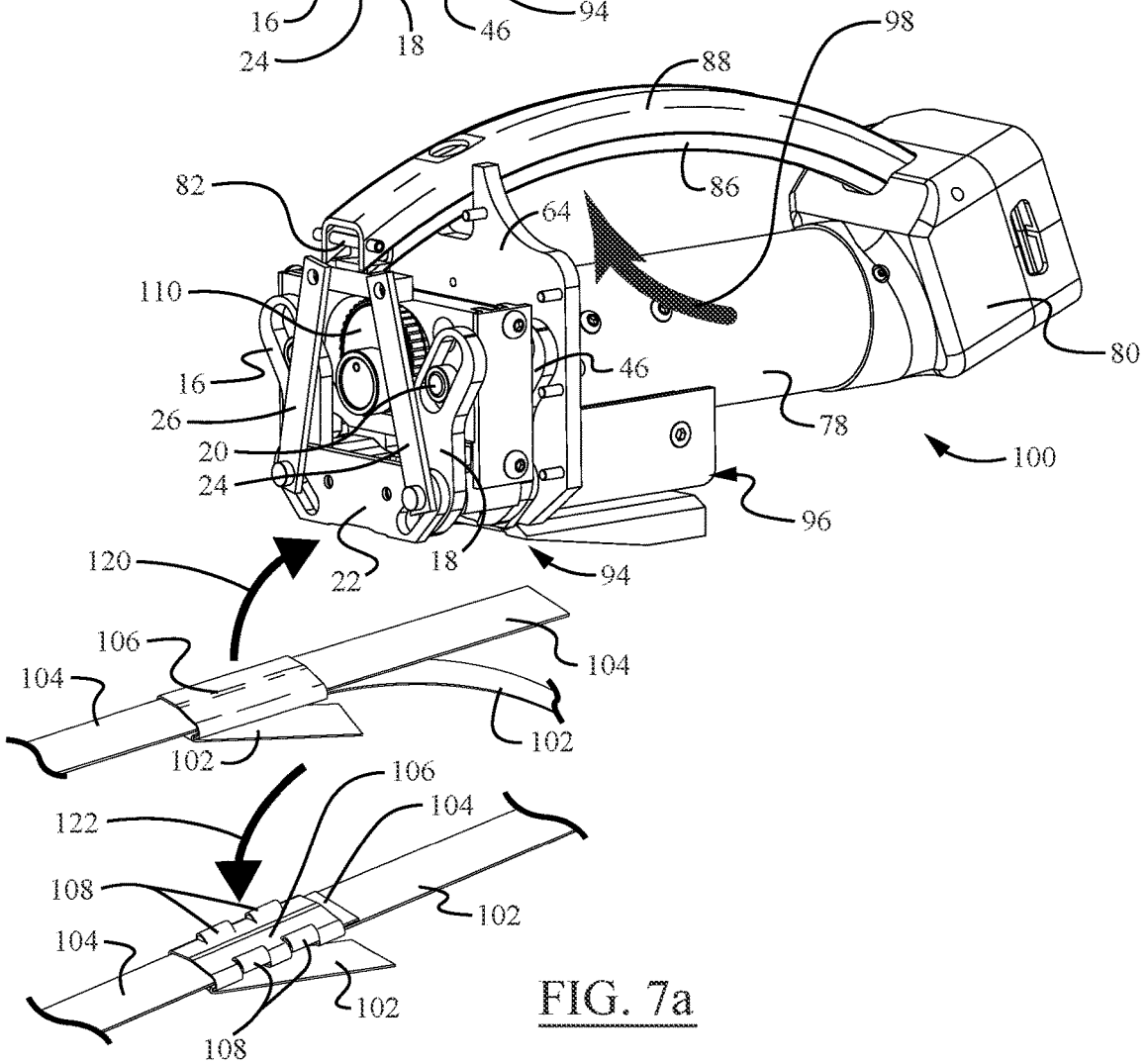
FIG. 7*a* is still another perspective view of the strapping tool of FIG. 1, wherein the front cover of the sealing assembly has been removed, and the jaws of the sealing assembly are shown in a raised state so that a piece of strapping may be loaded into the strapping tool, and wherein pieces of strapping with notched and unnotched seal members are additionally illustrated.
Figure 6B:
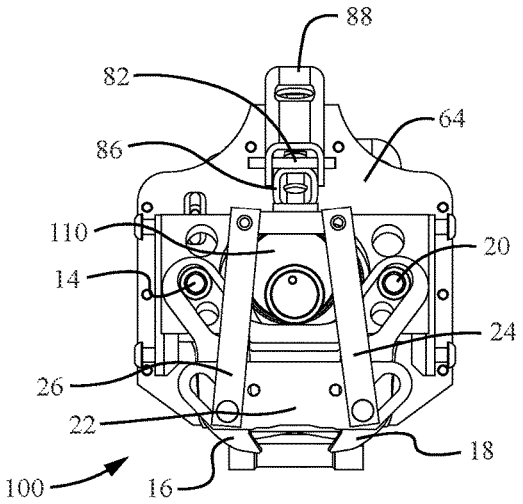
FIG. 6*b* is a front end view of the internal components of the sealing assembly of the strapping tool of FIG. 1, wherein the jaws of the sealing assembly are shown in the engaging, lowered state.
Figure 7B:
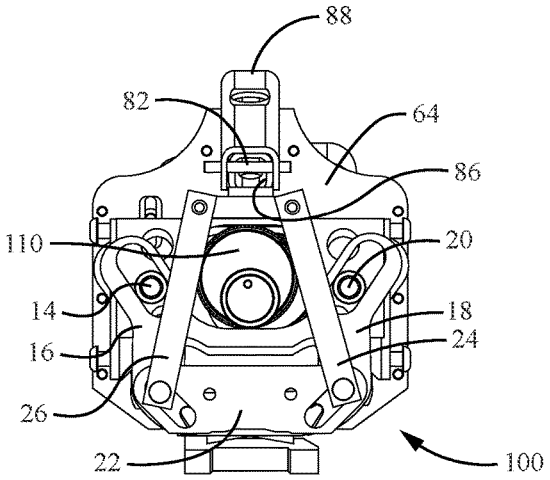
FIG. 7*b* is another front end view of the internal components of the sealing assembly of the strapping tool of FIG. 1, wherein the jaws of the sealing assembly are shown in the raised state so that a piece of strapping may be loaded into the strapping tool.
Figure 8:
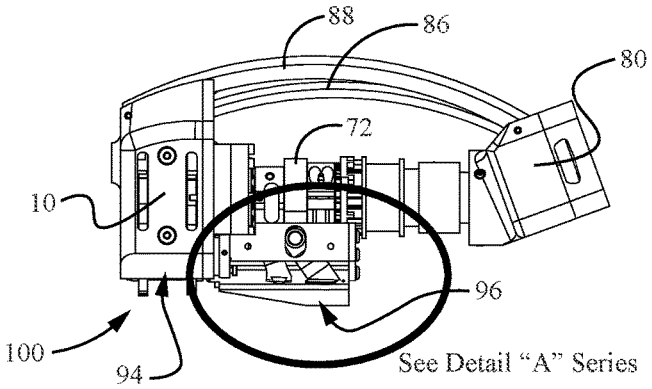
FIG. 8 is a side elevational view of the strapping tool of FIG. 1, wherein the cover of the tensioning assembly has been removed so as to illustrate the internal components of the tensioning assembly.
Figure 9:
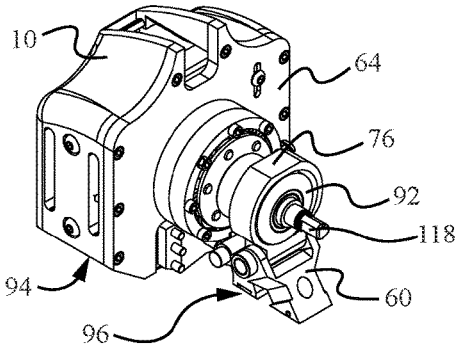
FIG. 9 is a perspective view of a front portion of the strapping tool of FIG. 1, which includes the sealing and tensioning assemblies.
Figure 10:
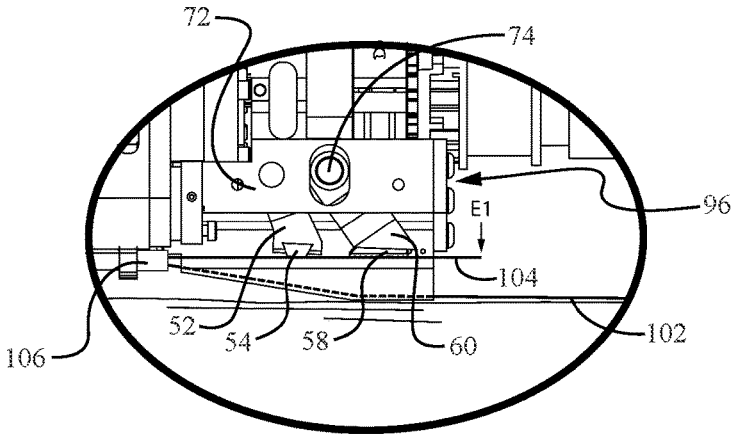
FIG. 10 is an enlarged partial side view of the tensioning assembly shown together with a piece of strapping at a first position (Detail "A-1")

Next, with reference to FIGS. 6*a*-7*b*, the jaw lifting assembly of the illustrative strapping tool 100 will be described. The jaw lifting assembly of the strapping tool 100 is configured to raise the sealing jaw members 16, 18, 44, 46 out of a strapping pass line of the strapping tool 100 so that the piece of strapping 102, 104 is capable of being inserted into the strapping tool 100 (see e.g., FIG. 7*a*). As will be described hereinafter, in the illustrative embodiment, the jaw lifting assembly raises a portion of the sealing assembly 94 that includes the sealing jaw members 16, 18, 44, 46, but does not raise the entire sealing assembly 94. As best shown in the exploded view of FIG. 5, in the illustrative embodiment, each of the sealing jaw members 16, 18, 44, 46 comprises a body portion with an elongate aperture formed therethrough. The diagonally-oriented elongate aperture of each sealing jaw member 16, 18, 44, 46 enables the sealing jaw members 16, 18, 44, 46 to be retractably displaced into the strapping tool when the sealing jaw members 16, 18, 44, 46 are simultaneously raised by the jaw lifting assembly (as shown in FIGS. 7*a* and 7*b*). As shown in FIGS. 13*a*-15, 17, and 18, the head portion of each cam bearing 14, 20, 48 is disposed in a respective diagonally-oriented elongate aperture of a respective sealing jaw member 16, 18, 44, 46 so as to operatively couple the sealing jaw members 16, 18, 44, 46 to the front and rear cam follower members 28, 32. When the sealing jaw members 16, 18, 44, 46 are actuated by the electric motor 78 into a sealing position for notching the strapping seal member 106 (as described above), the cam bearing members 14, 20, 48 are displaced within their respective elongate apertures of their respective sealing jaw members 16, 18, 44, 46 while the sealing jaw members 16, 18, 44, 46 are pivoted about rotational axes passing through the center of the jaw pivot pins 34, 36.

Referring again to FIGS. 6*a* and 7*a*, in the illustrative embodiment, the jaw lifting assembly further comprises a displaceable handle portion 86 operatively coupled to the sealing jaw members 16, 18, 44, 46. As shown in these figures, the displaceable lower handle portion 86 is received within the upper handle portion 88 that is affixed to the housing of the strapping tool 100. As shown in the exploded view of FIG. 5, the front pin 82 attaches the immovable upper handle portion 88 to the front housing 10, while the rear pin 84 forms the pivotal axis for the displaceable lower handle portion 86 relative to the immovable upper handle portion 88 (i.e., the rear pin 84 pivotably couples the rear end of the lower handle portion 86 to the upper handle portion 88). When the handle portion 86 is depressed by a user, the sealing jaw members 16, 18, 44, 46 are raised out of the strapping pass line of the strapping tool 100. In the illustrative embodiment, the sealing assembly 94 of the strapping tool 100 is not pivotably coupled to the tensioning assembly 96 of the strapping tool 100, but rather the raising of the sealing jaw members 16, 18, 44, 46 allows the strapping pass line to be cleared of the jaw obstruction so that the strapping can be loaded into the strapping tool 100.

Now, with reference primarily to FIGS. 6*a*-7*b*, the functionality of the jaw lifting assembly of the strapping tool 100 will be described. Initially, when the displaceable lower handle portion 86 is depressed by a user, the jaw lifter arms 24, 26, which are coupled to the lower handle portion 86 by the jaw lifter connector bar 12, are raised upwardly and the lower ends of the jaw lifter arms 24, 26 are spread apart from one another (see FIG. 7*b*). As the jaw lifter arms 24, 26 are raised and their lower ends are spread apart from one another, the jaw pivot pins 34, 36 are displaced in a diagonally upward manner within the diagonally-oriented elongate apertures of front and rear connector members 22, 66 (see FIGS. 7*a* and 7*b*). In turn, the upward and outward displacement of the jaw pivot pins 34, 36 causes the sealing jaw members 16, 18, 44, 46 to be raised upwardly and out of the strapping pass line of the strapping tool 100 so that the piece of strapping 102, 104 and seal member 106 is capable of being inserted into the strapping tool 100. Different operational positions of the jaw lifting assembly are illustrated in FIGS. 6*a*-7*b*. In FIGS. 6*a* and 6*b*, the sealing jaw members 16, 18, 44, 46 are depicted in their lowered, engaging state prior to a user squeezing the displaceable lower handle portion 86 to raise the sealing jaw members 16, 18, 44, 46 to load the strapping 102, 104 and seal member 106 into the strapping tool 100. In FIGS. 7*a* and 7*b*, the sealing jaw members 16, 18, 44, 46 are depicted in their raised, disengaging state after the user has pulled up on the displaceable lower handle portion 86 (as diagrammatically indicated by the curved arrow 98 in FIG. 7*a*), so as to raise the sealing jaw members 16, 18, 44, 46 so that the strapping 102, 104 and seal member 106 is able to be loaded into the strapping tool 100 for the performance of the tensioning and sealing operations. In FIG. 7*a*, the loading of the strapping 102, 104 and seal member 106 is diagrammatically illustrated by the curved arrow 120, while the removal of the strapping 102, 104 and seal member 106 after the tensioning and sealing operations have been performed is diagrammatically illustrated by the curved arrow 122.

Turning to FIGS. 5, 17, and 18, it can be seen that, in the illustrative embodiment, the sealing assembly 94 of the strapping tool 100 further comprises a cutting blade 50 for cutting the piece of strapping (see FIG. 18). As shown in FIG. 18, the cutting cam 62 pushes down on the top edge of the cutting blade 50 so as to cut the piece of strapping. As such, when the cutting cam 62 reaches a predetermined rotational position, the cutting cam 62 drives the cutting blade 50 downwardly so as to slice through the piece of strapping (i.e., the cutting blade 50 is slidably displaced in a downward direction by the cutting cam 62 so as to assume its engaged, cutting position). As shown in FIGS. 17 and 18, the cutting blade 50 is enclosed within a cutting blade housing 51, and the cutting blade 50 slides relative to the stationary cutting blade housing 51. Referring to FIGS. 17 and 18, it can be seen that the cutting blade 50 is disposed adjacent to the rear pair of sealing jaw members 44, 46. In the illustrative embodiment, the cutting cam 62 is also driven by the cam drive shaft 118 that provides power to the sealing assembly 94 and the tensioning assembly 96. After the rear pair of sealing jaw members 44, 46 applies the notch to the rear portion of the seal member, the cutting cam 62 revolves around the drive shaft 118 and physically pushes the cutting blade 50 down through the strapping, thereby slicing the excess end portion of the strap so that it can be removed from the remainder of the strap.

Now, referring to FIGS. 6*a*-20, the tensioning and sealing operation of the strapping tool 100 of the illustrative embodiment will now be described. Initially, a piece of strapping 128, 130 (i.e., a piece of steel strapping, poly strapping, or cord strapping) of one of a number of sizes is looped around the package or bundle 126 that requires the restraint (see e.g., FIG. 19). Then, the user threads a first free end of the strapping through a seal member or banding clip 132. After which, the user bends the first free end of the strapping back so that it is not able to be pulled out of the seal member 132 (e.g., as shown in FIGS. 2, 3, and 7*a*). Next, the user inserts the second free end of the strapping through the seal member 132 so that a continuous loop is formed around the bundle 126. Then, the strapping 128, 130 and seal member 132 are loaded into the strapping tool 100 by using the jaw lift assembly described above in conjunction with FIGS. 6*a*-7*b* to lift the sealing jaw members 16, 18, 44, 46 out of the strapping pass line. The actuation of the jaw lifting assembly by the depressing of the handle portion 86 allows the strapping 128, 130 and seal member 132 to be inserted into the tool 100 (see FIG. 3). As shown in FIG. 3, the strapping 128, 130 is inserted into the slot of the tool 100 between the tensioning foot 58 and the wedge-shaped plate on the bottom of the tool 100. Once the seal member 132 is in the correct position, the handle portion 86 is released by the user, the sealing jaw members 16, 18, 44, 46 return back to their engaged position with the seal member 132. At this point, the strapping 128, 130 and seal member 132 is held in place prior to the initiation of the tensioning and sealing operations. Then, the control button 90 is depressed by the user so that the tension is applied to the strapping 128, 130 by the tensioning assembly 96 in the manner described above in conjunction with FIGS. 10-12*b*. Finally, once the strapping has been pulled tight by the tensioning assembly 96 of the tool 100, the motor 78 reverses direction so that the sealing teeth of the sealing jaw members 16, 18, 44, 46 notch the metal seal member or banding clip (see FIGS. 2, 7*a*, and 20) and the cutting blade 50 cuts the excess portion of the strap from the strapping around the bundle 126. The notched seal member ensures that the strapping around the bundle 126 does not release its tension. Once the excess portion of the strap is cut by the cutting blade 50, the user squeezes the handle portion 86 to retract the sealing jaw members 16, 18, 44, 46, thereby freeing the strapping 128, 130 and seal member 132 from the tool 100.

A second illustrative embodiment 200 of a strapping tool is illustrated in FIGS. 21-26. Referring to these figures, it can be seen that, in many respects, the second illustrative embodiment of the strapping tool is similar to that of the first illustrative embodiment. Moreover, many elements are common to both such embodiments. For example, the tensioning assembly 296 of the strapping tool 200 is generally the same as the tensioning assembly 96 described above with regard to the strapping tool 100. However, the sealing assembly 294 of the strapping tool 200 differs from the sealing assembly 94 of the strapping tool 100 described above, and thus shall be described hereinafter. In particular, unlike the sealing assembly 94 of the strapping tool 100, the sealing jaw members on only one side of the strapping tool 200 are lifted for the loading of the strapping.

Figure 21:
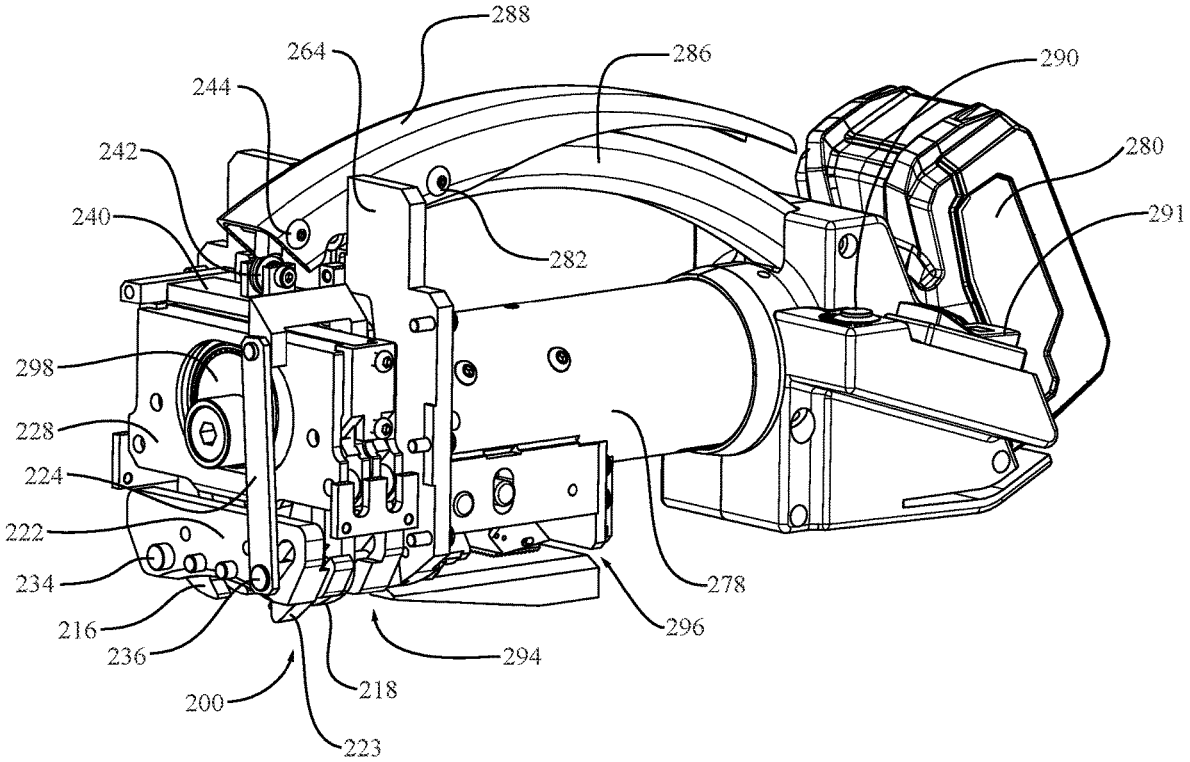
FIG. 21 is an assembled perspective view of a strapping tool, according to a second embodiment of the invention, wherein the front cover of the sealing assembly has been removed, and the jaws on both sides of the sealing assembly are shown in an engaging, lowered state.
Figure 22:
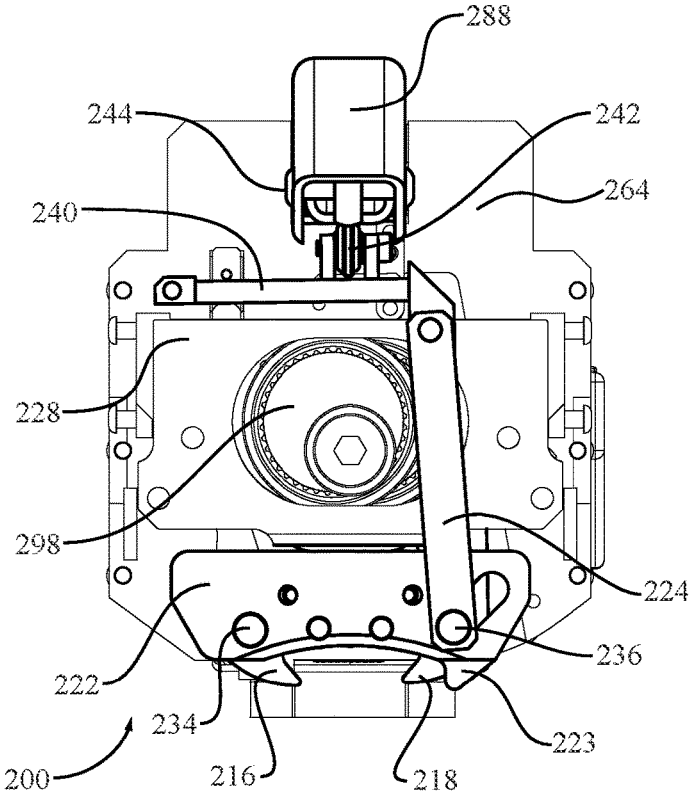
FIG. 22 is a front end view of the internal components of the sealing assembly of the strapping tool of FIG. 21, wherein the jaws on both sides of the sealing assembly are shown in the engaging, lowered state.

Now, with reference to FIGS. 21-26, the sealing assembly 294 of the illustrative strapping tool 200 will be described in detail. Referring initially to FIG. 21, in the second illustrative embodiment, the sealing assembly 294 generally includes a plurality of cam members (e.g., including front cam 298 and a similar rear cam), a plurality of cam follower members (e.g., including front cam follower member 228 and a similar rear cam follower member), and a plurality of sealing jaw members (e.g., including front sealing jaws 216, 218 and similar rear sealing jaws). Similar to that described above for the first illustrative embodiment, the plurality of sealing cam members of the sealing assembly 294 are disposed on a cam shaft driven by motor 278. In the illustrative embodiment, each of the sealing cam members is eccentric, and thus has a variable radii cam surface geometry. Also, similar to the aforedescribed first embodiment, the plurality of sealing jaw members of the sealing assembly 294 comprises a front pair of sealing jaw members 216, 218 and a similar rear pair of sealing jaw members. As shown in FIGS. 21-26, it can be seen that the sealing jaw members 216, 218 each comprise respective sealing teeth for forming the notched portions in the seal member 106 (see e.g., FIG. 2). The front cam member 298 is operatively coupled to the front pair of sealing jaw members 216, 218 by the front cam follower member 228 so as to selectively activate the front pair of sealing jaw members 216, 218, and the rear cam member is operatively coupled to the rear pair of sealing jaw members by the rear cam follower member so as to selectively activate the rear pair of sealing jaw members. Turning again to the front view of FIG. 25, it can be seen that the front sealing jaw member 216 on the first side (i.e., the left side) is operatively coupled to the front cam follower member 228 by upper and lower roller members 214*a*, 214*b*, while the front sealing jaw member 218 on the second side (e.g., the right side) is operatively coupled to the front cam follower member 228 by upper and lower roller members 220*a*, 220*b*. The arcuate displacement of the front sealing jaw members 216, 218 during the notching of the seal member is represented diagrammatically by the curved arrows 238 in FIG. 25. The rear pair of sealing jaw members is operatively coupled to the rear cam follower member by similar pairs of roller members. In the illustrative embodiment, the front cam follower member 228 and the rear cam follower member are in form of front and rear sealing cam plate members with respective central apertures formed therein for receiving the respective front and rear cam members. Also, in the illustrative embodiment, the front and rear sealing cam plate members forming front cam follower member 228 and the rear cam follower member may have a central slot-like cavity disposed therein with an interior face 232 for accommodating roller members 214*a*, 214*b*, 220*a*, 220*b* and the upper diagonal leg portions of the sealing jaw members (see FIGS. 21 and 25). Advantageously, because the cam members apply forces centrally to the cam follower members, and the cam follower members apply forces centrally to the jaw sealing members (by virtue of the roller members being centrally located in the cam follower plate members, generally symmetrical notches are formed in the sealing member during the sealing operation of the tool 200. In addition, in the illustrative embodiment, the front and rear cam subassemblies of the sealing assembly 294 may be in the form of positive drive cams where the cam follower members are disposed around, and circumscribe their respective cam members.

With reference again to FIGS. 21-26, elongate jaw pivot pins 234, 236 extend in the front-to-back direction of the strapping tool 200, and pass through apertures in the front pair of sealing jaw members 216, 218 and the rear pair of sealing jaw members so as to define axes of rotation for the sealing jaw members. The sealing jaw members disposed on the first side (i.e., the left side) of the strapping tool 200 both pivot about the jaw pivot pin 234 during the notching of the seal member 106, while the sealing jaw members disposed on the second side (e.g., the right side) of the strapping tool 200 both pivot about the jaw pivot pin 236 during the notching of the seal member 106.

In the second illustrative embodiment, similar to the first illustrative embodiment described above, the internal components of the sealing assembly 294 are housed within a front housing member (not shown) of the strapping tool 200 and rear housing member 264 (see FIG. 21). Collectively, the front and rear housing members enclose the constituent components of the sealing assembly 294. Also, as shown in FIG. 21, it can be seen that the strapping tool 200 is provided with a rechargeable battery pack 280 that is removable from its battery mount on the rear end portion of the strapping tool 200 so that the battery 280 can be easily charged. In the illustrative embodiment, the rechargeable battery pack 280 is capable of powering both the electric motor 278 that drives both the tensioning assembly 296 and the sealing assembly 294. As shown in FIG. 21, similar to that described above for the first embodiment, the control system of the illustrative strapping tool 200 may include a single control button 290 (or start button 290) configured to control the operation of both the tensioning assembly 296 and the sealing assembly 294 (i.e., when depressed by a user, the start button 290 initiates the tensioning and sealing operations of the strapping tool 200). In addition, as shown in FIG. 21, the illustrative strapping tool 200 may further include a rocker switch 291 that allows the tool 200 to be used in a manual tension and seal mode. Because the notching functionality of the sealing assembly 294 is similar to the sealing assembly 94 described above, a description of the sealing assembly will not be repeated with regard to the second illustrative embodiment.

Figure 23:
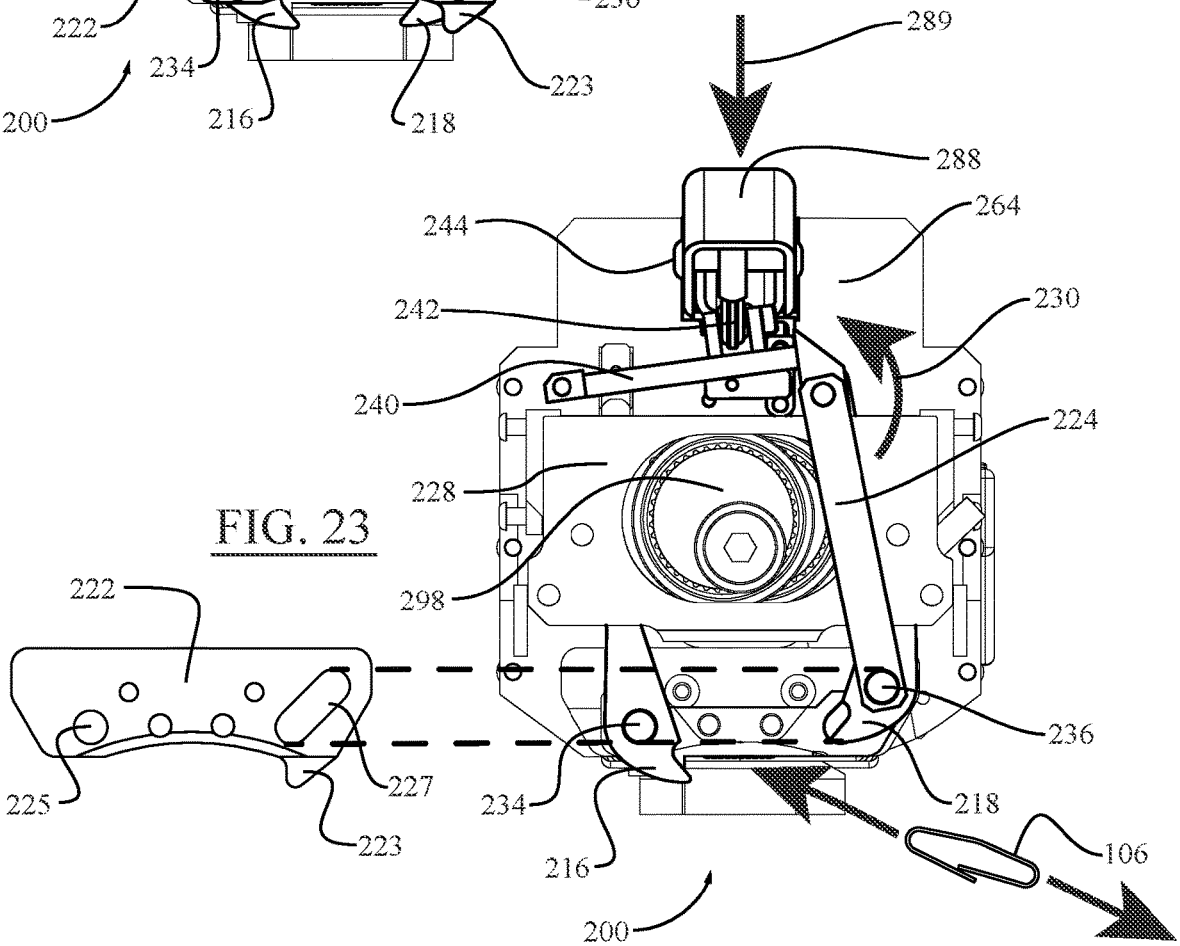
FIG. 23 is another front end view of the internal components of the sealing assembly of the strapping tool of FIG. 21 with the front bracket member shown removed to the side for more clearly illustrating components therebehind, wherein the jaws on one side (e.g., the right side) of the sealing assembly are shown in the raised state so that a piece of strapping and sealing member may be loaded into the strapping tool.
Figure 24:
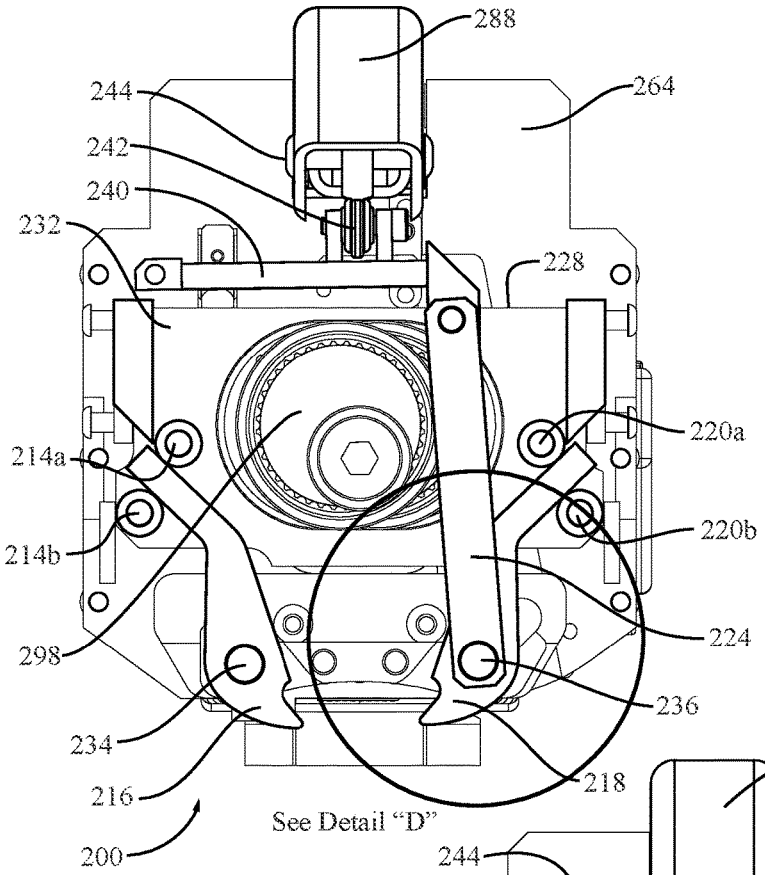
FIG. 24 is yet another front end view of the internal components of the sealing assembly of the strapping tool of FIG. 21.
Figure 25:
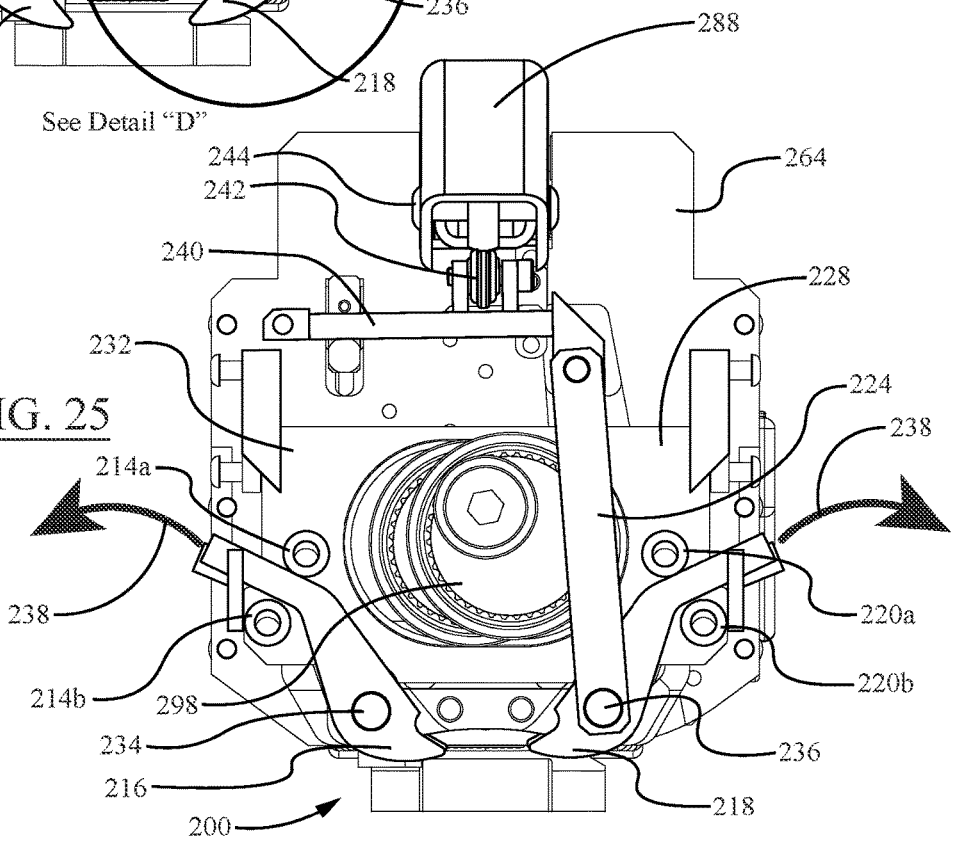
FIG. 25 is still another front end view of the internal components of the sealing assembly of the strapping tool of FIG. 21, wherein the notching or crimping action of the jaws of the sealing assembly is illustrated.

Next, with reference to FIGS. 21-26, the jaw lifting assembly of the illustrative strapping tool 200 will be described. In the second illustrative embodiment, the jaw lifting assembly of the strapping tool 200 is configured to raise the sealing jaw members on one side of the tool (e.g., on the right side) out of a strapping pass line of the strapping tool 200 so that the piece of strapping 102, 104 is capable of being inserted into the strapping tool 200. As will be described hereinafter, in the second illustrative embodiment, the jaw lifting assembly raises a portion of the sealing assembly 294 that includes the sealing jaw members on one side (e.g., the right side), but does not raise the sealing jaw members on the other side (e.g., the left side) of the sealing assembly 294. As best shown in FIG. 23, in the illustrative embodiment, the bracket member 222 is provided with a circular aperture 225 on the left side, and diagonally-oriented elongate aperture 227 on the right side. The diagonally-oriented elongate aperture 227 of the bracket member 222 enables the jaw pivot pin 236 on the right side to travel upwardly in the elongate aperture 227 when it is desired to raise the sealing jaw members on the right side, but the circular aperture 225 on the left side of the bracket member 222 constrains the jaw pivot pin 234 on the left side such that the sealing jaw members on the left side are not able to be raised. The sealing jaw members on the right side are retractably displaced into the strapping tool 200 when the sealing jaw members are raised by the jaw lifting assembly (as shown in FIG. 23).

Referring again to the perspective view of FIG. 21, in the illustrative embodiment, the jaw lifting assembly further comprises a displaceable upper handle portion 288 operatively coupled to the sealing jaw members on the right side of the tool 200. As shown in these figures, the displaceable upper handle portion 288 is pivotally coupled to the lower handle portion 286 by means of a pivot pin 282, which forms the pivotal axis for the displaceable upper handle portion 288 relative to the immovable lower handle portion 286 (i.e., the rear pin 282 pivotably couples the middle of the upper handle portion 288 to the lower handle portion 286). With combined reference to FIGS. 21-26, it can be seen that the front pin 244 couples the displaceable upper handle portion 288 to the linking components of the jaw lifting assembly. In the illustrative embodiment, with combined reference to FIGS. 21-26, it can be seen that the displaceable upper handle portion 288 is operatively coupled to the displaceable jaws on the right side of the tool 200 by rod end body 242, jaw lifter bracket 240, and jaw lifter vertical link 224. When the upper handle portion 288 is pressed down by a user (as diagrammatically indicated by the downward arrow 289 in FIG. 23), the jaw lifting assembly components 224, 240, 242 are displaced (as diagrammatically indicated by the curved arrow 230 in FIG. 23), and the sealing jaw members on the right side of the tool 200 are raised out of the strapping pass line of the strapping tool 200. In the illustrative embodiment, the sealing assembly 294 of the strapping tool 200 is not pivotably coupled to the tensioning assembly 296 of the strapping tool 200, but rather the raising of the sealing jaw members on the right side of the tool 200 allows the strapping pass line to be cleared of the jaw obstruction so that the strapping can be loaded into the strapping tool 200.

Figure 26:
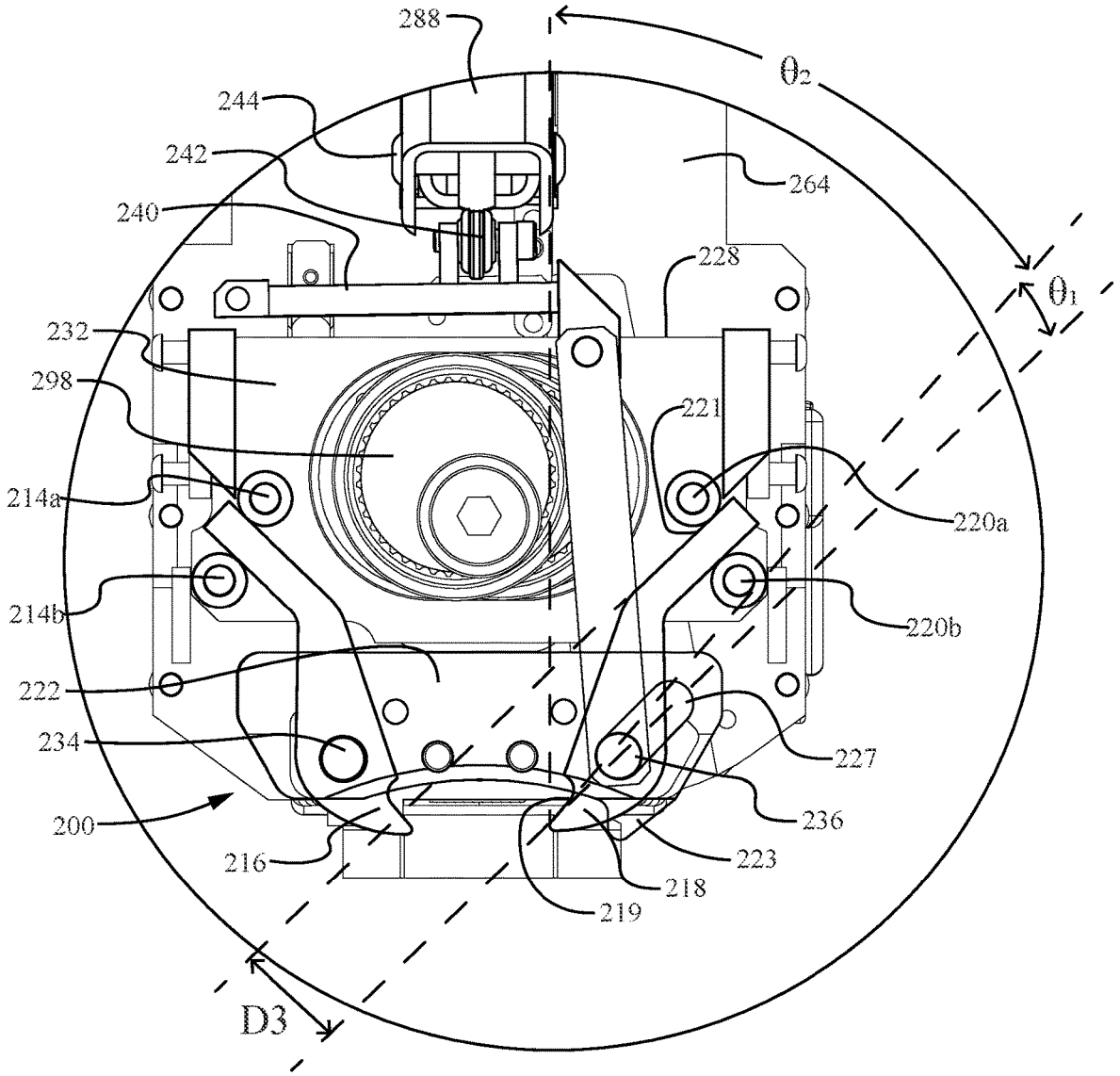
FIG. 26 is an enlarged view of a portion of the front end view of FIG. 24 (Detail "D"), wherein the geometric parameters of the sealing jaw face are illustrated.

In the illustrative embodiment, the tool 200 advantageously is provided with several features to prevent the inadvertent lifting of the sealing jaw members on the right side of the tool 200. First of all, with reference to FIG. 23, it can be seen that the bracket member 222 is provided with a downwardly extending protrusion 223 that prevents the sealing jaw members on the right side of the tool 200 from inadvertently opening when the tool is placed against a surface (e.g., against the package on which the strapping or banding is being applied). For example, in the case where the tool 200 is placed against a package surface, the downwardly extending protrusion 223 of the bracket member 222 contacts the package surface, rather than the sealing jaw members on the right side, thus preventing the inadvertent lifting of the sealing jaws on the right side. In addition, the downwardly extending protrusion 223 of the bracket member 222 also prevents the sealing jaw members on the right side from inadvertently opening when the tool 200 is rested on a floor or other surface. In addition, with reference to FIG. 26, as another way to prevent the inadvertent lifting of the sealing jaw members on the right side of the tool 200, the geometry of the jaw face 219 of each right side sealing jaw member is configured such that it forms a first predetermined angle $\theta_1$ relative to the centerline of the diagonally-oriented elongate aperture 227 in the bracket member 222, and a second predetermined angle $\theta_2$ relative to a vertical reference line. In addition, as shown in FIG. 26, the sealing jaw members on the right side are configured such that there is predetermined spacing distance D3 between the centerline of the pivot pin 236 and the upper face 221 of each sealing jaw member 218 that contacts the upper roller members 220*a*. In the illustrative embodiment, the first predetermined angle $\theta_1$ between the jaw face 219 and the centerline of the diagonally-oriented elongate aperture 227 may be approximately 5 degrees, the second predetermined angle $\theta_2$ between the jaw face 219 and the vertical reference line may be approximately 40 degrees, and the determined spacing distance D3 between the centerline of the pivot pin 236 and the upper jaw face 221 may be approximately 0.88. Advantageously, these geometric parameters (i.e., $\theta_1$, $\theta_2$, D3) of the sealing jaw members on the right side of the tool 200 holds the sealing jaw members in a locked position during the notching of the seal member, and prevents inadvertent lifting of the sealing jaw members on the right side of the tool 200 (i.e., because of these geometric parameters, the pivot pin 236 is maintained in its "sealing home position" where it is pushed against the lower curved end of the elongate aperture 227 during sealing). Further, as yet another way to prevent the inadvertent lifting of the sealing jaw members on the right side of the tool 200, in the illustrative embodiment, the tool 200 is provided with a pre-grip cycle prior to the execution of the tensioning cycle described above. After the user presses the start button 290 on the tool 200, the pre-grip cycle is initiated (e.g., in the first ½ second of the tool operational sequence), and the sealing jaw members rotate and slightly pinch the sealing member. Then, the tool operational sequence follows with the aforedescribed tensioning cycle, and then the aforedescribed sealing cycle. In the illustrative embodiment, once the rotation starts for actuating the sealing jaw members, the pivot pin 236 is pulled tight into its "sealing home position" against the lower curved end of the elongate aperture 227, and it remains in tight engagement with the lower curved end of the elongate aperture 227 during the entire sealing operation.

A third illustrative embodiment 300 of a strapping tool is illustrated in FIGS. 27-32. Referring to these figures, it can be seen that, in many respects, the third illustrative embodiment is similar to that of the first and second illustrative embodiments. Moreover, many elements are common to all of the embodiments. For example, the tensioning assembly 396 of the strapping tool 300 is generally the same as the tensioning assemblies 96, 296 described above with regard to the strapping tools 100, 200. However, the sealing assembly 394 of the strapping tool 300 differs from the sealing assemblies 94, 294 of the strapping tools 100, 200 described above, and thus shall be described hereinafter. Although, similar to the sealing assembly 294 of the strapping tool 200, the sealing jaw members on only one side of the strapping tool 300 are lifted for the loading of the strapping.

Figure 27:
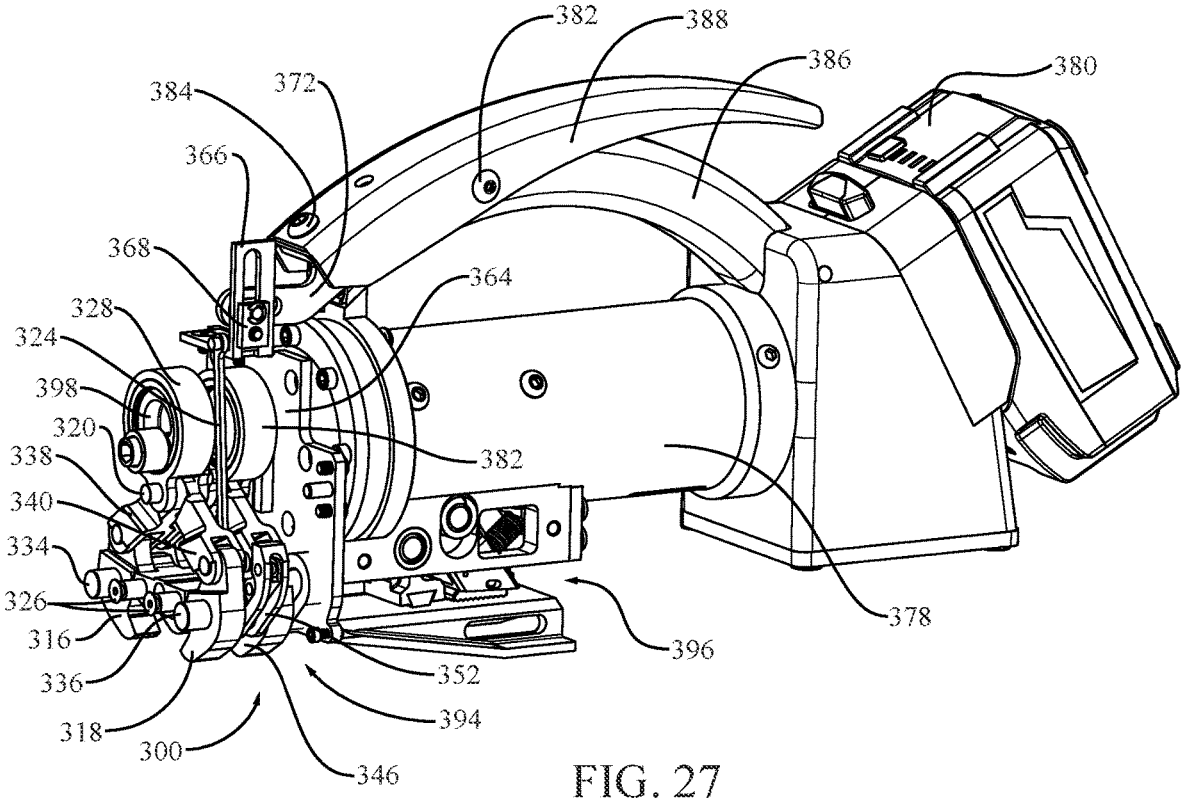
FIG. 27 is an assembled perspective view of a strapping tool, according to a third embodiment of the invention, wherein the front cover of the sealing assembly has been removed, and the jaws on both sides of the sealing assembly are shown in an engaging, lowered state.
Figure 28:
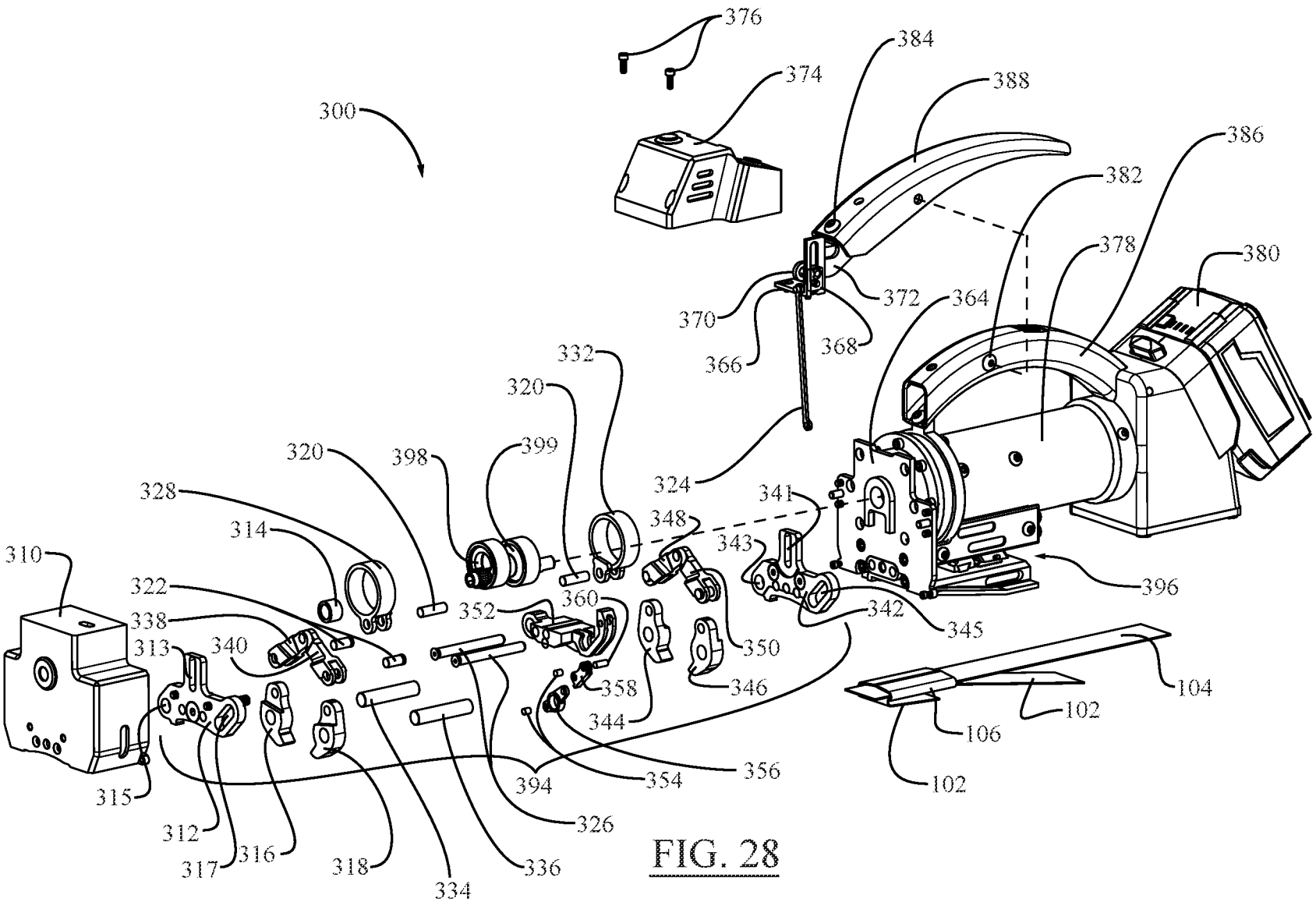
FIG. 28 is a partially exploded perspective view of the strapping tool of FIG. 27, wherein the components of the sealing assembly have been exploded from the remainder of the tool.
Figure 29:
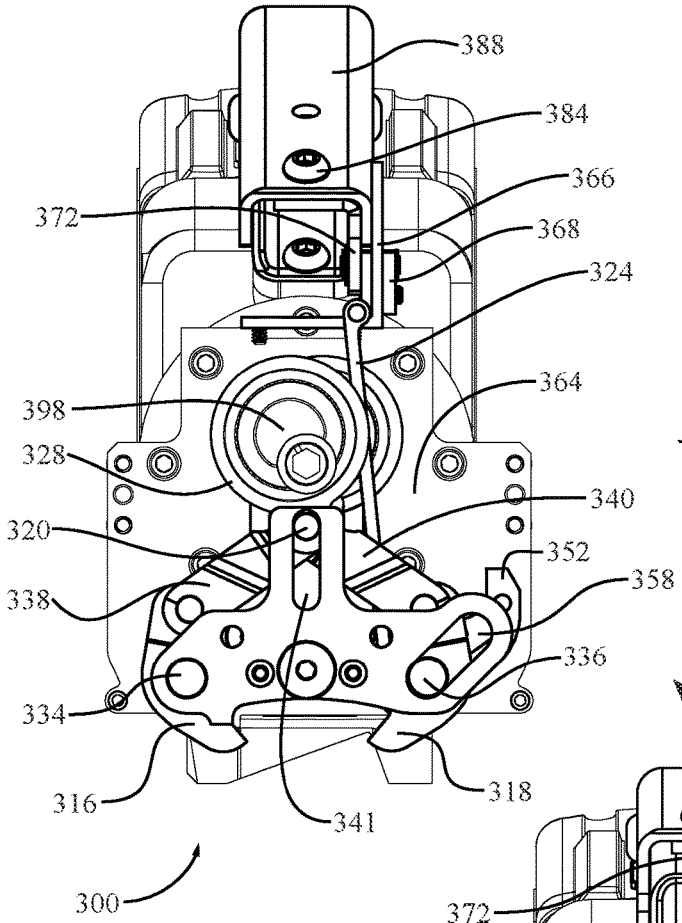
FIG. 29 is a front end view of the internal components of the sealing assembly of the strapping tool of FIG. 27, wherein the jaws on both sides of the sealing assembly are shown in the engaging, lowered state.
Figure 30:
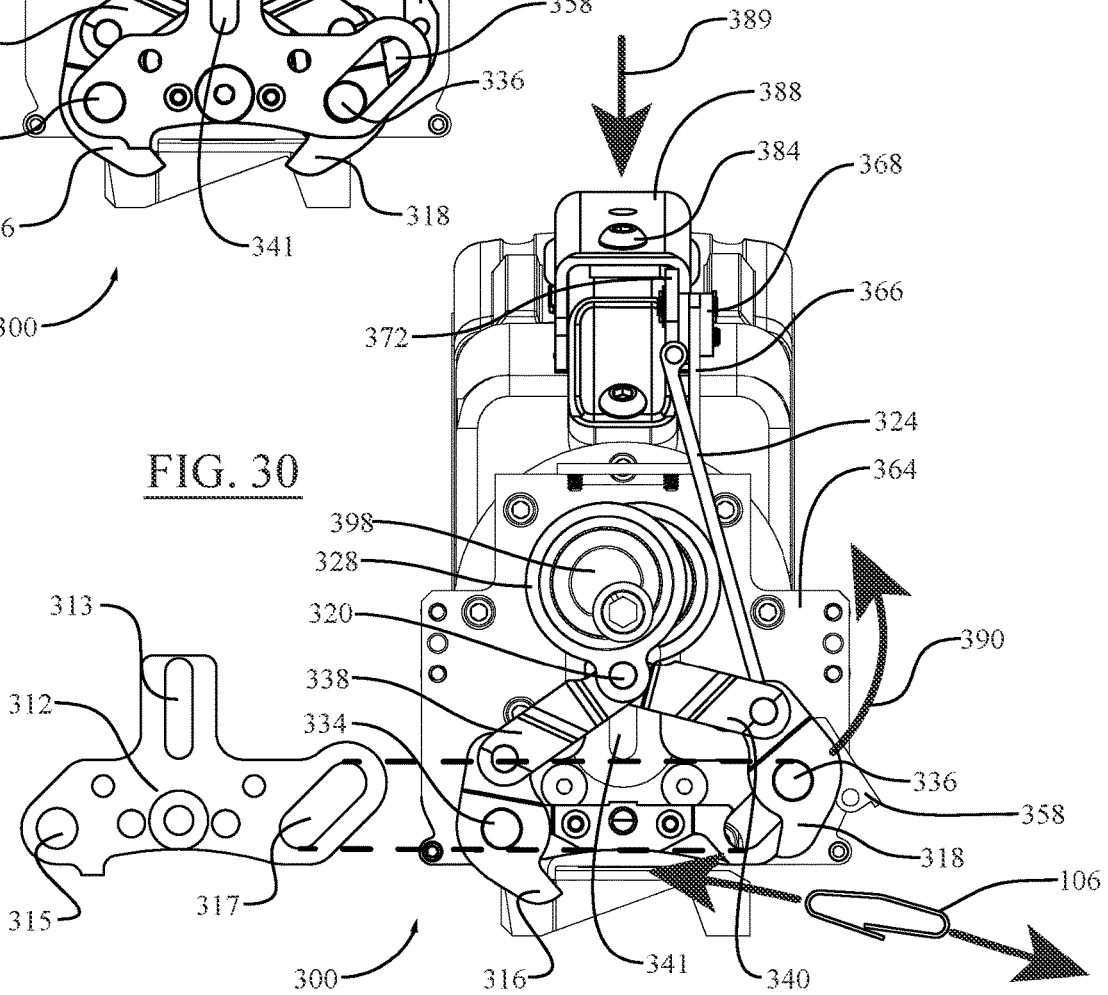
FIG. 30 is another front end view of the internal components of the sealing assembly of the strapping tool of FIG. 27 with the front bracket member shown removed to the side for more clearly illustrating components therebehind, wherein the jaws on one side (e.g., the right side) of the sealing assembly are shown in the raised state so that a piece of strapping and a sealing member may be loaded into the strapping tool.

Now, with reference to FIGS. 27-32, the sealing assembly 394 of the illustrative strapping tool 300 will be described in detail. Referring initially to the exploded view of FIG. 28, in the second illustrative embodiment, the sealing assembly 394 generally includes a plurality of cam members 398, 399, a plurality of cam follower ring members 328, 332, and a plurality of sealing jaw members 316, 318, 344, 346. As shown in FIG. 28, the plurality of cam members 398, 399 of the sealing assembly 394 comprises a first cam member 398 (i.e., a front sealing cam 398) and a second cam member 399 (i.e., a rear sealing cam 399) disposed on the cam shaft driven by a motor 378. In the illustrative embodiment, each of the cam members 398, 399 is eccentric, and thus has a variable radii cam surface geometry. Also, in the illustrative embodiment, the plurality of sealing jaw members 316, 318, 344, 346 of the sealing assembly 394 comprises a front pair of sealing jaw members 316, 318 and a rear pair of sealing jaw members 344, 346. As shown in FIGS. 27, 28, and 30, it can be seen that the sealing jaw members 316, 318, 344, 346 each comprise respective sealing teeth for forming the notched portions 108 in the seal member 106 (see FIG. 2). In addition, similar to that described above for the first two embodiments, each of the first and second cam members 398, 399 is operatively coupled to the electric motor 378 by means of a cam shaft (i.e., the cams 398, 399 are both simultaneously rotated by the cam shaft about a rotational axis passing through the center of the hexagonal fastener of the cam shaft in FIGS. 29-32). The end of the cam shaft is rotatably supported by a roller bearing 314 (see FIG. 28). The first cam member 398 is operatively coupled to the front pair of sealing jaw members 316, 318 by the front cam follower ring member 328 so as to selectively activate the front pair of sealing jaw members 316, 318 (see FIGS. 30 and 31). The second cam member 399 is operatively coupled to the rear pair of sealing jaw members 344, 346 by the rear cam follower ring member 332 so as to selectively activate the rear pair of sealing jaw members 344, 346 (see FIGS. 27 and 28). Turning again to FIGS. 27 and 28, it can be seen that the front pair of sealing jaw members 316, 318 are operatively coupled to the front cam follower ring member 328 by a first pair of linkage arm members 338, 340, while the rear pair of sealing jaw members 344, 346 are operatively coupled to the rear cam follower ring member 332 by a second pair of linkage arm members 348, 350. The upper ends of the linkage arm members 338, 340 are coupled to the front cam follower ring member 328 by means of a ring pin 320, while the lower ends of the linkage arm members 338, 340 are coupled to respective sealing jaw members 316, 318 by respective jaw pins 322. Similarly, the upper ends of the linkage arm members 348, 350 are coupled to the rear cam follower ring member 332 by means of a ring pin 320, while the lower ends of the linkage arm members 348, 350 are coupled to respective sealing jaw members 344, 346 by respective jaw pins 322. In the illustrative embodiment, the front and rear cam follower ring members 328, 332 are in form of ring members with respective central apertures formed therein for receiving the respective first and second cam members 398, 399. In the illustrative embodiment, the front and rear cam subassemblies of the sealing assembly 394 may be in the form of positive drive cams where the cam follower members 328, 332 are disposed around, and circumscribe their respective cam members 398, 399.

In the illustrative embodiment, as best shown in the exploded view of FIG. 28, the sealing assembly 394 further comprises first and second bracket members 312, 342 for constraining the displacement of the ring pins 320 at the upper ends of the linkage arm members 338, 340, 348, 350 to a direction normal to a surface of the piece of strapping 104 (i.e., an upward/downward displacement). As shown in FIGS. 28-32, the front and rear bracket members 312, 342 comprise vertical elongate slots 313, 341 formed therein such that the ring pins 320 are guided up and down within the slots 313, 341 when follower ring members 328, 332 are displaced by the cam members 398, 399.

With reference again to FIGS. 27 and 28, elongate jaw pivot pins 334, 336 extend in the front-to-back direction of the strapping tool 300, and pass through apertures in the front pair of sealing jaw members 316, 318 and the rear pair of sealing jaw members 344, 346 so as to define axes of rotation for the sealing jaw members 316, 318, 344, 346. The sealing jaw members 316, 344 disposed on the first side (i.e., the left side) of the strapping tool 300 both pivot about the jaw pivot pin 334 during the notching of the seal member 106, while the sealing jaw members 318, 346 disposed on the second side (e.g., the right side) of the strapping tool 300 both pivot about the jaw pivot pin 336 during the notching of the seal member 106.

In the third illustrative embodiment, similar to the first and second illustrative embodiments described above, the internal components of the sealing assembly 394 are housed within a front housing member 310 of the strapping tool 300 and a rear housing member 364 (see FIG. 28). Also, in the third illustrative embodiment, a top housing member 374 covers the top portion of the sealing assembly 394. The top housing member 374 may be secured using fastener members 376 (e.g., cap screws 376). Collectively, the front, rear, and top housing members 310, 364, 374 enclose the constituent components of the sealing assembly 394. Also, as shown in FIGS. 27 and 28, it can be seen that the strapping tool 300 is provided with a rechargeable battery pack 380 that is removable from its battery mount on the rear end portion of the strapping tool 300 so that the battery 380 can be easily charged. In the illustrative embodiment, the rechargeable battery pack 380 is capable of powering both the electric motor 378 that drives both the tensioning assembly 396 and the sealing assembly 394. Also, similar to the first two embodiments described above, the control system of the illustrative strapping tool 300 may include a single control button (or start button) configured to control the operation of both the tensioning assembly 396 and the sealing assembly 394 (i.e., when depressed by a user, the start button initiates the tensioning and sealing operations of the strapping tool 300). Because the notching functionality of the sealing assembly 394 is similar to the sealing assembly 94 described above, a description of the sealing assembly will not be repeated with regard to the third illustrative embodiment.

Next, with reference to FIGS. 27-32, the jaw lifting assembly of the illustrative strapping tool 300 will be described. In the third illustrative embodiment, similar to the second embodiment described above, the jaw lifting assembly of the strapping tool 300 is configured to raise the sealing jaw members on one side of the tool (e.g., on the right side) out of a strapping pass line of the strapping tool 300 so that the piece of strapping 102, 104 is capable of being inserted into the strapping tool 300. As will be described hereinafter, in the third illustrative embodiment, the jaw lifting assembly raises a portion of the sealing assembly 394 that includes the sealing jaw members on one side (e.g., the right side), but does not raise the sealing jaw members on the other side (e.g., the left side) of the sealing assembly 394. As best shown in the exploded view of FIG. 28, in the illustrative embodiment, first and second bracket members 312, 342 are provided with a circular aperture 315, 343 on the left sides thereof, and a diagonally-oriented elongate aperture 317, 345 on the right sides thereof. The diagonally-oriented elongate apertures 317, 345 of the first and second bracket members 312, 342 enable the jaw pivot pin 336 on the right side to travel upwardly in the elongate apertures 317, 345 when it is desired to raise the sealing jaw members 318, 346 on the right side (i.e., after the jaw locking arm 358 is disengaged, which will be explained hereinafter), but the circular apertures 315, 343 on the left sides of the first and second bracket members 312, 342 constrain the jaw pivot pin 334 on the left side such that the sealing jaw members 316, 344 on the left side are not able to be raised. The sealing jaw members 318, 346 on the right side are retractably displaced into the strapping tool 300 when the sealing jaw members are raised by the jaw lifting assembly (as shown in FIG. 30).

Referring again to FIGS. 27 and 28, in the illustrative embodiment, the jaw lifting assembly further comprises a displaceable upper handle portion 388 operatively coupled to the sealing jaw members 318, 346 on the right side of the tool 300. As shown in these figures, the displaceable upper handle portion 388 is pivotally coupled to the lower handle portion 386 by means of a pivot pin 382, which forms the pivotal axis for the displaceable upper handle portion 388 relative to the immovable lower handle portion 386 (i.e., the rear pin 382 pivotably couples the middle of the upper handle portion 388 to the lower handle portion 386). With combined reference to FIGS. 27-30, it can be seen that the fastener member 384 (e.g., cap screw 384) couples the displaceable upper handle portion 388 to the linking components of the jaw lifting assembly. In the illustrative embodiment, with combined reference to FIGS. 27, 28, and 30, it can be seen that the displaceable upper handle portion 388 is operatively coupled to the displaceable jaws 318, 346 on the right side of the tool 300 by bracket member 372, slidable carriage member 368 with flat washer 370, and jaw lifter vertical link 324. When the upper handle portion 388 is pressed down by a user (as diagrammatically indicated by the downward arrow 389 in FIG. 30), the jaw lifting assembly components 372, 368, and 324 are displaced (as diagrammatically indicated by the curved arrow 390 in FIG. 30), and the sealing jaw members 318, 346 on the right side of the tool 300 are raised out of the strapping pass line of the strapping tool 300. When the upper handle portion 388 is pressed down by the user, the slidable carriage member 368 slides vertically upward in the vertical slot of L-shaped bracket 366 so as to raise the jaw lifter vertical link 324, and to lift the sealing jaw members 318, 346 operatively coupled to the jaw lifter vertical link 324. In the illustrative embodiment, the sealing assembly 394 of the strapping tool 300 is not pivotably coupled to the tensioning assembly 396 of the strapping tool 300, but rather the raising of the sealing jaw members 318, 346 on the right side of the tool 300 allows the strapping pass line to be cleared of the jaw obstruction so that the strapping can be loaded into the strapping tool 300.

Figure 31:
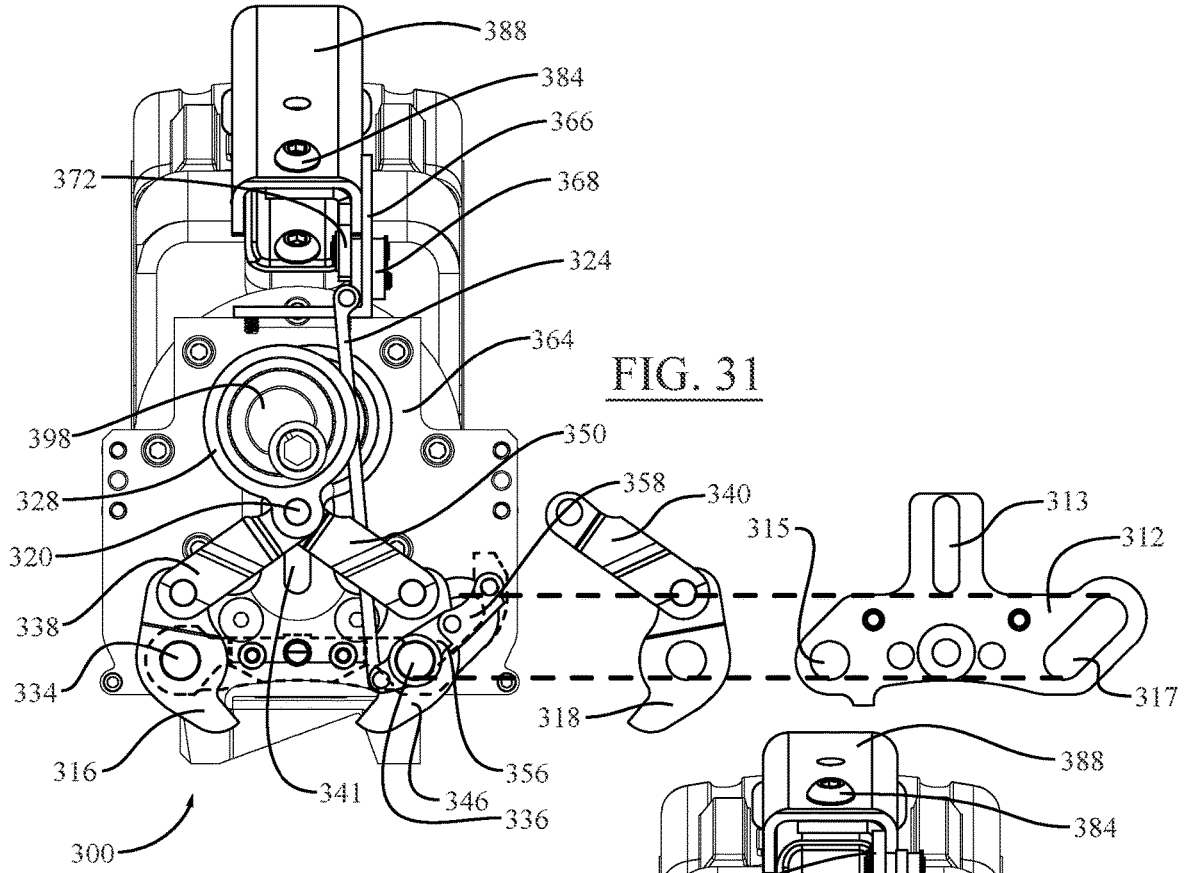
FIG. 31 is yet another front end view of the internal components of the sealing assembly of the strapping tool of FIG. 27, wherein a front jaw on one side (e.g., the right side) and the front bracket member of the sealing assembly have been removed so as to better illustrate the jaw locking mechanism when it is in its engaged state.
Figure 32:
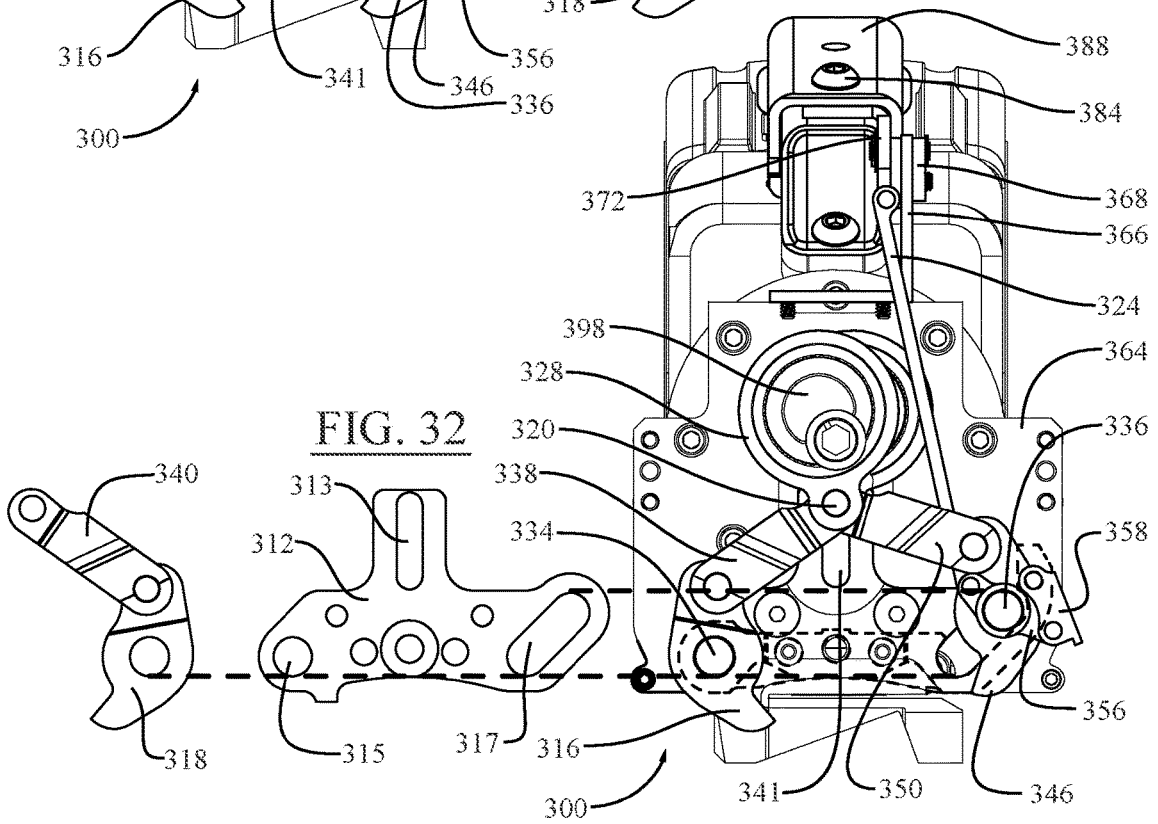
FIG. 32 is still another front end view of the internal components of the sealing assembly of the strapping tool of FIG. 27, wherein a front jaw on one side (e.g., the right side) and the front bracket member of the sealing assembly have been removed so as to better illustrate the jaw locking mechanism when it is in its disengaged state so as to allow the jaws on that side to be raised.

In the third illustrative embodiment, similar to the second illustrative embodiment, the tool 300 advantageously is provided with several features to prevent the inadvertent lifting of the sealing jaw members 318, 346 on the right side of the tool 300. First of all, with reference to FIGS. 28-30, it can be seen that the sealing jaw members 318, 346 on the right side of the tool 300 are provided with a jaw locking mechanism 352, 356, 358 (e.g., in the form of a knuckle press joint) that locks the sealing jaw members 318, 346 in the down position so as to prevent the sealing jaw members 318, 346 from inadvertently raising from their engaged sealing position. As such, in the third embodiment, before a user is able to lift the sealing jaw members 318, 346 by pressing the upper handle portion 388, he or she must manually disengage the jaw locking arm 358, which then allows the sealing jaw members 318, 346 to be raised. As best shown in the exploded view of FIG. 28, in addition to the jaw locking arm 358, the jaw locking mechanism of the tool 300 further comprises the center spacer member 352, small lock pin members 354, rotating arm 356, and large lock pin member 360. The center spacer member 352 is connected to first and second bracket members 312, 342 by elongate fastener members 326 (e.g., elongate screws 326). When the jaw locking arm 358 is disengaged by the user, the rotating arm 356 is able to rotate clockwise and the lower end of the jaw lifter vertical link 324 is able to be raised upward so that the sealing jaw members 318, 346 are able to be lifted once the user presses down on the upper handle portion 388. The locked position of the sealing jaw members 318, 346 is depicted in FIG. 31, and the unlocked position of the sealing jaw members 318, 346 is depicted in FIG. 32. In addition, as another way to prevent the inadvertent lifting of the sealing jaw members 318, 346 on the right side of the tool 300, the geometry of the jaw faces of the right side sealing jaw members 318, 346 may be geometrically configured in the same manner as described above for the second embodiment (e.g., using a first predetermined angle $\theta_1$ of approximately 5 degrees, a second predetermined angle $\theta_2$ of approximately 40 degrees, and a predetermined spacing distance D3 of approximately 0.88). Further, as yet another way to prevent the inadvertent lifting of the sealing jaw members 318, 346 on the right side of the tool 300, the tool 300 also may be provided with the pre-grip cycle described above with regard to the second embodiment.

Any of the features or attributes of the above described embodiments and variations can be used in combination with any of the other features and attributes of the above described embodiments and variations as desired.

It is readily apparent that the aforedescribed strapping tools 100, 200, 300 offer numerous advantages. First, the strapping tools 100, 200, 300 utilize fewer and simpler components than conventional tools so as to reduce the overall complexity of the tool, and thereby provide a more cost effective alternative for performing strapping operations. Secondly, the strapping tools 100, 200, 300 are more reliable than conventional strapping tools so as to minimize the disruption of strapping operations resulting from tool repairs and replacements. Thirdly, the aforedescribed strapping tools 100, 200, 300 are easier to transport than conventional strapping tools (i.e., the strapping tools 100, 200, 300 are more mobile than conventional strapping tools).

Although the invention has been shown and described with respect to a certain embodiment or embodiments, it is apparent that this invention can be embodied in many different forms and that many other modifications and variations are possible without departing from the spirit and scope of this invention While exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A strapping tool, comprising:

a motive power source; and a tensioning assembly operatively coupled to the motive power source, the tensioning assembly including a cam member and at least one tensioning foot member, the cam member operatively coupling the at least one tensioning foot member to the motive power source, and the at least one tensioning foot member of the tensioning assembly configured to apply tension to a piece of strapping while being driven in an oscillatory manner by the motive power source.

2. The strapping tool according to claim 1, wherein the motive power source comprises one of: (i) a pneumatic motor, (ii) an electric motor, and (iii) a liquid fuel-based motor.

3. The strapping tool according to claim 1, wherein the cam member is in the form of an eccentric cam member.

4. The strapping tool according to claim 1, further comprising a cam bracket member, the at least one tensioning foot member being operatively coupled to the cam member by means of the cam bracket member.

5. The strapping tool according to claim 4, further comprising a tensioning leg and a leg pin member, the tensioning leg operatively coupling the at least one tensioning foot member to the cam bracket member by means of the leg pin member.

6. The strapping tool according to claim 4, wherein the cam bracket member is disposed around, and circumscribes the cam member.

7. The strapping tool according to claim 1, further comprising a sealing assembly, the sealing assembly configured to notch or crimp a strapping seal member so as to secure the piece of strapping around a package or bundle of items;

wherein the motive power source supplies power to both the sealing assembly and the tensioning assembly by means of a drive shaft.

8. The strapping tool according to claim 7, further comprising one or more one-way bearings disposed on the drive shaft so as to enable the tensioning assembly to be actuated by rotating the drive shaft in a first rotational direction and the sealing assembly to be actuated by rotating the drive shaft in a second rotational direction that is opposite to the first rotational direction.

9. The strapping tool according to claim 7, further comprising a single control button configured to control the operation of both the tensioning assembly and the sealing assembly.

10. The strapping tool according to claim 1, further comprising a holding foot member pivotably coupled to a frame member of the strapping tool;

wherein, during the tensioning of the piece of strapping, the at least one tensioning foot member continually grabs and pulls a predetermined amount of the piece of strapping through a seal member, and the holding foot member prevents the piece of strapping from slipping back.

11. A strapping tool, comprising:

a tensioning assembly, the tensioning assembly including at least one tensioning foot member, the at least one tensioning foot member configured to apply tension to a piece of strapping while being driven in an oscillatory manner by the motive power source;

a sealing assembly, the sealing assembly configured to notch or crimp a strapping seal member so as to secure the piece of strapping around a package or bundle of items;

a drive shaft operatively coupled to the tensioning assembly and the sealing assembly, the drive shaft driving both the sealing assembly and the tensioning assembly; and a motive power source, the motive power source operatively coupled to the drive shaft so as to supply power to both the sealing assembly and the tensioning assembly by means of the drive shaft.

12. The strapping tool according to claim 11, wherein the tensioning assembly further comprises a cam member, the cam member operatively coupling the at least one tensioning foot member of the tensioning assembly to the drive shaft.

13. The strapping tool according to claim 11, wherein the drive shaft has a linear configuration such that the tensioning assembly and the sealing assembly have an aligned common driving axis.

14. The strapping tool according to claim 11, further comprising one or more one-way bearings disposed on the drive shaft so as to enable the tensioning assembly to be actuated by rotating the drive shaft in a first rotational direction and the sealing assembly to be actuated by rotating the drive shaft in a second rotational direction that is opposite to the first rotational direction.

15. The strapping tool according to claim 11, wherein the motive power source comprises a battery-powered motor.

* * * * *